US012188169B2

(12) United States Patent
Jung et al.

(10) Patent No.: US 12,188,169 B2
(45) Date of Patent: Jan. 7, 2025

(54) LAUNDRY TREATING APPARATUS

(71) Applicant: LG Electronics Inc., Seoul (KR)

(72) Inventors: Youngho Jung, Seoul (KR); Sanghee Yoo, Seoul (KR); Daehan Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 997 days.

(21) Appl. No.: 17/177,795

(22) Filed: Feb. 17, 2021

(65) Prior Publication Data

US 2021/0254263 A1 Aug. 19, 2021

(30) Foreign Application Priority Data

Feb. 19, 2020 (KR) ..... 10-2020-0020460
Oct. 13, 2020 (KR) ..... 10-2020-0131837

(51) Int. Cl.
*D06F 39/12* (2006.01)
*D06F 29/00* (2006.01)
*D06F 34/28* (2020.01)

(52) U.S. Cl.
CPC ..... *D06F 39/125* (2013.01); *D06F 29/005* (2013.01); *D06F 34/28* (2020.02)

(58) Field of Classification Search
CPC ..... D06F 34/28; D06F 34/34; D06F 29/00; D06F 29/005; D06F 39/12; D06F 39/125
See application file for complete search history.

(56) References Cited

U.S. PATENT DOCUMENTS 4,535,610 A 8/1985 Fey et al.
11,519,117 B2 * 12/2022 Kwon ..... D06F 29/005
(Continued)

FOREIGN PATENT DOCUMENTS

CN 101346508 1/2009
CN 104652080 5/2015
(Continued)

OTHER PUBLICATIONS

EP Extended European Search Report in European Appln. No. 21157579.0, dated Jun. 22, 2021, 10 pages.
(Continued)

*Primary Examiner* — David G Cormier
(74) *Attorney, Agent, or Firm* — Fish & Richardson P.C.

(57) ABSTRACT

A laundry treating apparatus a first treating apparatus and a second treating apparatus that is disposed vertically below the first treating apparatus and supports the first treating apparatus. The first treating apparatus includes a first front panel disposed at a front side of the first treating apparatus, and a first drum configured to accommodate laundry therein, and the second treating apparatus includes a second front panel disposed at a front side of the second treating apparatus, and a second drum configured to accommodate laundry therein. The laundry treating apparatus includes a control panel that is disposed between the first front panel and the second front panel and operationally connected to the first treating apparatus and the second treating apparatus. The control panel includes an upper portion coupled to a lower portion of the first front panel, and a lower portion coupled to an upper portion of the second front panel.

20 Claims, 24 Drawing Sheets

(56) References Cited

U.S. PATENT DOCUMENTS

| | | | | |
|---|---|---|---|---|
| 2007/0068036 | A1* | 3/2007 | Choi | D06F 58/38 34/550 |
| 2007/0175907 | A1* | 8/2007 | Kempe | D06F 39/12 220/639 |
| 2007/0209403 | A1* | 9/2007 | Byun | D06F 39/12 68/3 R |
| 2008/0256984 | A1* | 10/2008 | Lim | D06F 34/34 68/12.23 |
| 2009/0126419 | A1* | 5/2009 | Yoon | D06F 37/42 68/212 |
| 2009/0217545 | A1* | 9/2009 | Banicevic | D06F 34/28 312/228 |
| 2014/0157673 | A1* | 6/2014 | Bazzinotti | D06F 39/14 49/70 |
| 2018/0258576 | A1* | 9/2018 | Kim | D06F 31/005 |

FOREIGN PATENT DOCUMENTS

| | | |
|---|---|---|
| CN | 108239844 | 7/2018 |
| EP | 2703536 | 3/2014 |
| EP | 3521501 | 11/2017 |
| KR | 100652459 | 12/2006 |
| KR | 20070067464 | 6/2007 |
| KR | 10-2008-0021921 | 3/2008 |
| KR | 20080023444 | 3/2008 |
| KR | 20080035539 | 4/2008 |
| KR | 10-2008-0093345 | 10/2008 |
| KR | 101307575 | 9/2013 |
| KR | 20150121582 | 10/2015 |

OTHER PUBLICATIONS

Office Action in Chinese Appln. No. 202110195177.1, dated Aug. 31, 2022, 13 pages (with English translation).

Notice of Allowance in Korean Appln. No. 10-2020-0131837, dated Dec. 7, 2023, 10 pages (with English translation).

Office Action in Chinese Appln. No. 202110195177.1, dated Apr. 11, 2023, 20 pages (with English translation).

Office Action in European Appln. No. 21157579.0, dated May 3, 2023, 5 pages.

* cited by examiner

LAUNDRY TREATING APPARATUS

CROSS-REFERENCE TO RELATED APPLICATIONS

This application claims the benefit of Korean Patent Application Nos. 10-2020-0020460, filed on Feb. 19, 2020, and 10-2020-0131837, filed on Oct. 13, 2020, the disclosures of which are incorporated herein by reference as if fully set forth herein.

TECHNICAL FIELD

The present disclosure relates to a laundry treating apparatus, and relates to a laundry treating apparatus including a first treating apparatus on an upper side and a second treating apparatus on a lower side.

BACKGROUND

A laundry treating apparatus is an apparatus that can receive laundry such as clothes, bedding, and the like into a drum to perform treatment of the laundry to remove contamination from the laundry, to dry the laundry, or to do both.

For example, the laundry treating apparatus may remove the contamination from the laundry by performing processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet defining an appearance of the laundry treating apparatus, a tub accommodated in the cabinet, a drum that is rotatably mounted inside the tub and configured to receive laundry therein, and a detergent feeder that feeds detergent into the drum.

The drum may be rotated by a motor while wash water is supplied to the laundry accommodated in the drum, and dirt on the laundry may be removed by friction with the drum and the wash water.

The detergent feeder may perform a detergent feeding function to improve a washing effect. For example, the detergent may include a substance, such as fabric detergent, fabric softener, fabric bleach, and the like, that may enhance the washing effect. Detergent in a powder form and detergent in a liquid form can be used as the detergent.

In some cases, the laundry treating apparatus may dry the laundry to remove moisture from the laundry by supplying dry air to the laundry.

The laundry treating apparatus may include a cabinet, a drum rotatably disposed inside the cabinet, heating devices for heating or drying the air supplied to the laundry, and the like.

As the dry air is supplied to the laundry accommodated in the drum, the moisture present in the laundry may be evaporated and removed by the dry air, and water can be removed from the laundry.

In some examples, a laundry treating apparatus may include a plurality of treating apparatuses. For examples, the laundry treating apparatus can include a first treating apparatus on an upper side and a second treating apparatus on a lower side. Each of the first treating apparatus and the second treating apparatus includes a manipulation unit and a display.

The plurality of treating apparatuses may be distinguished from each other and include respective manipulation units and respective displays. In some cases, a user may respectively identify the states of the respective plurality of treating apparatuses, and respectively manipulate the plurality of treating apparatuses. In some cases, the user may operate the plurality of treating apparatuses in conjunction with each other.

Therefore, in the laundry treating apparatus including the plurality of treating apparatuses, it may be important to improve a convenience of the user in identifying or manipulating the operating states of the plurality of treating apparatuses and to provide an efficient arrangement relationship and a stable and effective coupling relationship of components of the plurality of treating apparatuses.

SUMMARY

The present disclosure describes a laundry treating apparatus including an efficient arrangement and coupling structure of a control panel for simultaneously identifying or controlling a plurality of treating apparatuses for treating laundry.

The present disclosure also describes a laundry treating apparatus having structural stability effectively improved and excellent coupling stability.

The present disclosure further describes a laundry treating apparatus including one control panel that can control a plurality of treating apparatuses and that can be constructed in a structurally stable manner with the plurality of treating apparatuses.

In some implementations, the laundry treating apparatus can include a plurality of treating apparatuses including a first treating apparatus that can dry laundry, and a second treating apparatus that can wash laundry.

The first treating apparatus and the second treating apparatus can have a structure stacked together in a vertical direction. For instance, the first treating apparatus can be disposed on the second treating apparatus.

Each of the first treating apparatus and the second treating apparatus can have a laundry inlet into which the laundry is inserted defined at a front side thereof, and a drum for accommodating therein the laundry inserted into each cabinet through the laundry inlet. In a front loader type apparatus, each of the first treating apparatus and the second treating apparatus can have a shaft configured to rotate about a rotation axis direction extending parallel to a front and rear direction.

In some implementations, the control panel can define a portion of a front face of the laundry treating apparatus. For example, the control panel can be disposed between a first front panel of the first treating apparatus and a second front panel of the second treating apparatus, so that a front face of the control panel can be exposed forward.

In some examples, one control panel can control both of the first treating apparatus and the second treating apparatus. The control panel can include a display for displaying operating states of the first treating apparatus and the second treating apparatus, and a manipulation unit for a user to control the first treating apparatus and the second treating apparatus.

In some implementations, the control panel can provide the laundry treating apparatus with the excellent coupling stability. For example, the structural stability of the laundry treating apparatus can be improved by coupling the top face, the bottom face, and both side faces of the control panel to portions of the first treating apparatus and the second treating apparatus.

According to one aspect of the subject matter described in this application, a laundry treating apparatus a first treating apparatus and a second treating apparatus that is disposed vertically below the first treating apparatus and supports the first treating apparatus. The first treating apparatus includes a first front panel disposed at a front side of the first treating apparatus, and a first drum configured to accommodate laundry therein, and the second treating apparatus includes a second front panel disposed at a front side of the second treating apparatus, and a second drum configured to accommodate laundry therein. The laundry treating apparatus includes a control panel that is disposed between the first front panel and the second front panel and operationally connected to the first treating apparatus and the second treating apparatus. The control panel includes an upper portion coupled to a lower portion of the first front panel, and a lower portion coupled to an upper portion of the second front panel.

Implementations according to this aspect can include one or more of the following features. For example, the first front panel can include a lower bending portion that extends rearward from a lower end of the first front panel and that is configured to couple to a top surface of the control panel, and the second front panel can include an upper bending portion that extends rearward from an upper end of the second front panel and that is configured to couple to a bottom surface of the control panel. In some examples, the top surface of the control panel can include a first panel fastening portion that is configured to be inserted into and coupled to the lower bending portion of the first front panel, and the bottom surface of the control panel can include a second panel fastening portion that is configured to be inserted into and coupled to the upper bending portion of the second front panel.

In some examples, each of the top surface and the bottom surface of the control panel can define an opening and a fastening elastic portion that extends along the opening, where the first panel fastening portion is disposed at the fastening elastic portion of the top surface of the control panel, and the second panel fastening portion is disposed at the fastening elastic portion of the bottom surface of the control panel. In some examples, the top surface of the control panel can include a panel support that protrudes upward and supports the lower bending portion of the first front panel.

In some implementations, the first treating apparatus can further include a lower frame disposed at a rear side of the control panel and configured to couple to the control panel. In some examples, the lower frame can include a main frame face that is positioned rearward relative to the control panel and that divides an interior of the first treating apparatus and the control panel from each other, and lateral extension portions that extend forward from lateral sides of the main frame face and are configured to couple to the control panel. In some examples, the lateral extension portions can include a first lateral extension portion that is disposed at one of the lateral sides of the main frame face and configured to face a first side surface of the control panel, the first lateral extension portion defining a hook inserting portion. The control panel can further include a side hook that protrudes toward the first lateral extension portion of the lower frame, where the side hook is configured to be inserted into the hook inserting portion and positioned between the first side surface of the control panel and the first lateral extension portion of the lower frame.

In some implementations, the control panel further includes a hook extension portion that extends rearward from a rear surface of the control panel, where the hook extension portion is configured to be spaced apart from the first side surface of the control panel and positioned between the first side surface of the control panel and the first lateral extension portion of the lower frame. The side hook can be disposed at an end of the hook extension portion. In some examples, the lateral extension portions can further include a second lateral extension portion that is disposed at another of the lateral sides of the main frame face and configured to face a second side surface of the control panel. The second lateral extension portion can defines a through hole, and the control panel can further include a penetrating member that is configured to pass through the second side surface of the control panel and couple to the through hole.

In some implementations, the lower frame can further include an upper extension portion that extends forward from an upper end of the main frame face and that is coupled to the lower bending portion of the first front panel. In some examples, the top surface of the control panel can be configured to be inserted to a portion of the lower frame between the lower bending portion and the upper extension portion, and the upper extension portion can include a top coupling portion that protrudes upward and is inserted into the lower bending portion. The control panel can define a coupling portion receiving groove at a rear side of the top surface of the control panel, and the top coupling portion can be configured to be inserted into the coupling portion receiving groove from the rear side of the top surface of the control panel.

In some examples, the control panel can further include an electric parts coupling portion that protrudes downward from an inner side of the top surface of the control panel and that is configured to couple to electric parts disposed inside the control panel. The lower frame can define a front receiving groove at a front side of the upper extension portion, and the electric parts coupling portion can be configured to be inserted into the front receiving groove from the front side of the upper extension portion. In some examples, each of the top surface and the bottom surface of the control panel extends rearward from a front surface of the control panel, where a length of the top surface of the control panel extending rearward from the front surface of the control panel is less than a length of the bottom surface of the control panel extending rearward from the front surface.

In some examples, the top surface of the control panel further defines a top opening, and the top surface includes a top face fastening elastic portion that extends along the top opening in a lateral direction, and a top panel fastening portion that protrudes from the top face fastening elastic portion and is configured to be inserted into the lower bending portion. The bottom surface of the control panel defines a bottom opening, and the bottom surface includes a bottom face fastening elastic portion that extends in a front direction along the bottom opening, and a bottom panel fastening portion that protrudes from the bottom face fastening elastic portion and is configured to be inserted into the upper bending portion.

In some implementations, the first treating apparatus can further include first side panels disposed at lateral sides of the first treating apparatus, and a length of the second front panel in a vertical direction can be greater than a length of the first front panel in the vertical direction. The upper portion of the second front panel can be located forward relative to the first side panels, and the control panel can be configured to be located forward relative to the first side panels, and the lower portion of the control panel is configured to be coupled to the upper portion of the second front panel. In some examples, a lower end of the first front panel is located vertically above than lower ends of the first side panels.

In some implementations, the first front panel and the second front panel can include a metal material, and the control panel can include a plastic material configured to electrically insulate the first front panel and the second front panel from each other. The control panel can be configured to absorb an impact applied to the first front panel or the second front panel.

According to another aspect, a laundry treating apparatus includes a first treating apparatus, a second treating apparatus that is disposed vertically below the first treating apparatus and supports the first treating apparatus, and a control panel operationally connected to the first treating apparatus and the second treating apparatus. The first treating apparatus includes a first front panel disposed at a front side of the first treating apparatus, and a first drum configured to accommodate laundry therein, and the second treating apparatus includes a second front panel disposed at a front side of the second treating apparatus, and a second drum configured to accommodate laundry therein. The control panel includes an upper portion that supports a lower portion of the first front panel, and a lower portion that is supported by an upper portion of the second front panel.

According to another aspect, a laundry treating apparatus includes a first treating apparatus, a second treating apparatus that is disposed vertically below the first treating apparatus and supports the first treating apparatus, and a control panel operationally connected to the first treating apparatus and the second treating apparatus. The first treating apparatus includes a first front panel disposed at a front side of the first treating apparatus, a pair of first side panels that are disposed at lateral sides of the first treating apparatus, and a first drum configured to accommodate laundry therein, and the second treating apparatus includes a second front panel disposed at a front side of the second treating apparatus, and a second drum configured to accommodate laundry therein. The control panel is disposed forward relative to the pair of first side panels.

In some implementations, the laundry treating apparatus can have the efficient arrangement and coupling structure of the control panel for simultaneously identifying or controlling the plurality of treating apparatuses for treating the laundry.

In some implementations, the laundry treating apparatus has an improved structural stability and excellent coupling stability.

DETAILED DESCRIPTION

Hereinafter, one or more implementations of the present disclosure will be described in detail with reference to the accompanying drawings such that a person having ordinary knowledge in the technical field to which the present disclosure belongs can easily implement the present disclosure.

Figure 1:
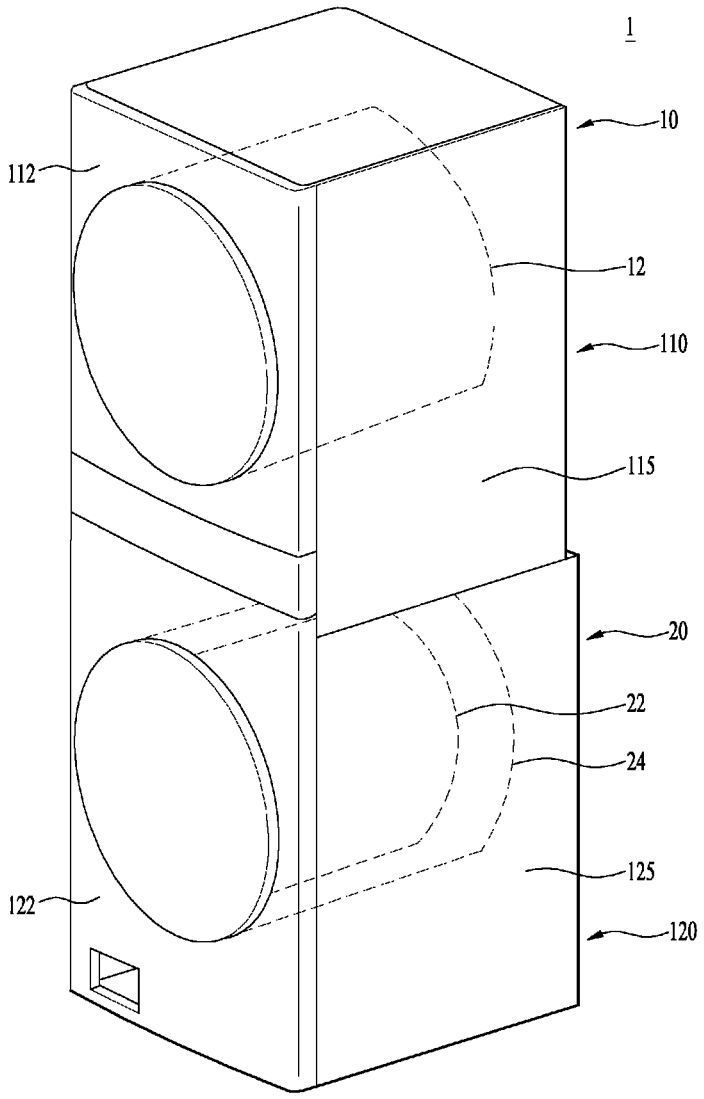
FIG. 1 is a perspective view showing an example of a laundry treating apparatus.

FIG. 1 shows an example of a laundry treating apparatus 1. In some implementations, the laundry treating apparatus 1 can include a first treating apparatus 10 and a second treating apparatus 20. The first treating apparatus 10 and the second treating apparatus 20 can be in various types for treating laundry, such as a washing machine for washing the laundry or a dryer for drying the laundry.

For example, the first treating apparatus 10 positioned on an upper side in FIG. 1, which is a dryer for drying the laundry, can have a first drum 12 disposed therein. The second treating apparatus 20 that is located on a lower side and supports the first treating apparatus 10 can correspond to the washing machine for washing the laundry, and can have a second drum 22 and a tub 24 arranged therein. When the second treating apparatus 20 corresponds to the laundry washing machine, the second drum 22 inside the second treating apparatus 20 can be rotatably disposed inside the tub 24.

In some implementations, the first treating apparatus 10 and the second treating apparatus 20 are not necessarily limited to the above types. When necessary, both the first treating apparatus 10 and the second treating apparatus 20 can be the washing machines or the dryers. In addition, the first treating apparatus 10 can be the washing machine, and the second treating apparatus 20 can be the dryer. The first treating apparatus 10 and the second treating apparatus 20 can be various apparatuses for treating the laundry.

The first treating apparatus 10 can include a first cabinet 110 forming an appearance thereof, and the first cabinet 110 can have a first front panel 112 on a front side thereof. A laundry inlet in communication with the first drum 12 can be defined in the first front panel 112, and the laundry inlet can be opened and closed by a cabinet door.

In addition, the first treating apparatus 10 can have each first side panel 115 on each of both faces thereof in a left and right direction Y, a first rear panel 118 on a rear face thereof, a first top panel on a top face thereof, and a first bottom panel 119 on a bottom face thereof.

The first front panel 112, the first side panels 115, the first rear panel 118, the first top panel, and the first bottom panel 119 can form the first cabinet 110 together, and have a coupling relationship with each other, and define a space in which internals constituting the first treating apparatus 10 such as the first drum 12 are arranged.

In the first treating apparatus 10, the laundry requiring the treatment and the like can be inserted into the first cabinet 110 through the laundry inlet and accommodated in the first drum 12, and a treating process by the first treating apparatus 10 such as washing, drying, and the like can be performed.

FIG. 1 illustrates the first treating apparatus 10 in which the laundry inlet is defined in the first front panel 112 along with the cabinet door, and the first drum 12 has a rotation axis parallel to a front and rear direction X.

In some examples, the laundry inlet may not be necessarily limited to being defined in the first front panel 112, and can be defined in the first side panel 115, the first top panel, or the like together with the cabinet door. For example, the first treating apparatus 10 can be a front loader type or a top loader type.

In some examples, the second treating apparatus 20 can include a second cabinet 120 forming an appearance thereof, and the second cabinet 120 can have a second front panel 122 on a front side thereof. A laundry inlet in communication with the second drum 22 can be defined in the second front panel 122, and the laundry inlet can be opened and closed by a cabinet door.

In addition, the second treating apparatus 20 can have each second side panel 125 on each of both faces thereof in the left and right direction Y, a second rear panel 128 on a rear face thereof, a second top panel on a top face thereof, and a second bottom panel on a bottom face thereof.

The second front panel 122, the second side panels 125, the second rear panel 128, the second top panel, and the second bottom panel can form the second cabinet 120 together, and have a coupling relationship with each other, and define a space in which internals constituting the second treating apparatus 20 such as the second drum 22 and the tub 24 are arranged.

In the second treating apparatus 20, the laundry requiring the treatment and the like can be inserted into the second cabinet 120 through the laundry inlet and accommodated in the second drum 22, and a treating process by the second treating apparatus 20 such as the washing, the drying, and the like can be performed.

FIG. 1 illustrates the second treating apparatus 20 in which the laundry inlet is defined in the second front panel 122 along with the cabinet door, and the second drum 22 has a rotation axis parallel to the front and rear direction X.

In some implementations, the laundry inlet may not be necessarily limited to being defined in the second front panel 122, and can be defined in the second side panel 125, the second top panel, or the like together with the cabinet door. For example, the first treating apparatus 10 can be the front loader type or the top loader type.

For example, the laundry inserted through the first front panel 112 can be accommodated in the first drum 12 to perform the washing, the drying or other treating processes, and the laundry inserted through the second front panel 122 can be accommodated in the second drum 22 to perform the washing, the drying, or other treating processes.

The first treating apparatus 10 can be disposed on the second treating apparatus 20, and thus, the second treating apparatus 20 can have a structure supporting the first treating apparatus 10 upward. For example, the second top panel of the second treating apparatus 20 can have a structure of directly or indirectly supporting the first bottom panel 119 of the first treating apparatus 10, and a bottom of the first treating apparatus 10 can be coupled with a top of the second treating apparatus 20.

In some implementations, a control panel 200 can be disposed between the first front panel 112 and the second front panel 122. The control panel 200 can be disposed between the first front panel 112 and the second front panel 122, and can be operationally connected to at least one of the first treating apparatus 10 and the second treating apparatus 20. For instance, the control panel 200 can provide signals to the first treating apparatus 10 and the second treating apparatus 20 to operate the first treating apparatus 10 and the second treating apparatus 20. In some examples, the control panel 200, the first treating apparatus 10, and the second treating apparatus 20 are connected to one another through a wireless communication.

The control panel 200 can have a front face 210, and side faces 240 on both sides in the left and right direction Y. The side face 240 can include a first side surface 242 on one side in the left and right direction Y and a second side surface 244 on the other side.

The control panel 200 can have a top face 220 and a bottom face 230. The front face 210, the side faces 240, the top face 220, and the bottom face 230 can be connected to each other. For example, the side faces 240, the top face 220, and the bottom face 230 can have a shape extending rearward from the front face 210.

The front face 210 of the control panel 200 can be exposed to the outside to form a front face of the laundry treating apparatus 1 in some implementations together with the first front panel 112 and the second front panel 122. The side face 240 of the control panel 200 can be exposed to the outside in the left and right direction Y, and the top face 220 and the bottom face 230 thereof can be inserted between the first front panel 112 and the second front panel 122 and may not be exposed to the outside.

The control panel 200 can be operationally connected to at least one of the first treating apparatus 10 and the second treating apparatus 20. The control panel 200 can include a display capable of indicating states of the first treating apparatus 10 and/or the second treating apparatus 20 disposed on the front face 210 thereof, and the first treating apparatus 10, and an input unit capable of inputting operation commands of the first treating apparatus 10 and/or the second treating apparatus 20.

Electric parts 224 can be arranged inside the control panel 200, that is, on a rear face of the front face 210. The electric parts 224 can be electrically connected to the first treating apparatus 10 and/or the second treating apparatus 20 and can exchange state information or control signals.

For example, the electric parts 224 can include a controller of the first treating apparatus 10 and a controller of the second treating apparatus 20, can include an integrated controller that controls the first treating apparatus 10 and the second treating apparatus 20 together, can include a panel controller connected to the controller of the first treating apparatus 10 and the controller of the second treating apparatus 20 in a control manner, or can be controlled by the controller of the first treating apparatus 10 and the controller of the second treating apparatus 20 without a separate controller.

The control panel 200 can include a rear face, but in some implementations, the rear face of the control panel 200 can be opened. The control panel 200 disposed between the first front panel 112 and the second front panel 122 can be positioned at a lower portion of the first treating apparatus 10 or at an upper portion of the second treating apparatus 20. The control panel 200 can be a plate or substantially flat shape. In some examples, the control panel 200 can have a curved shape.

Figure 2:
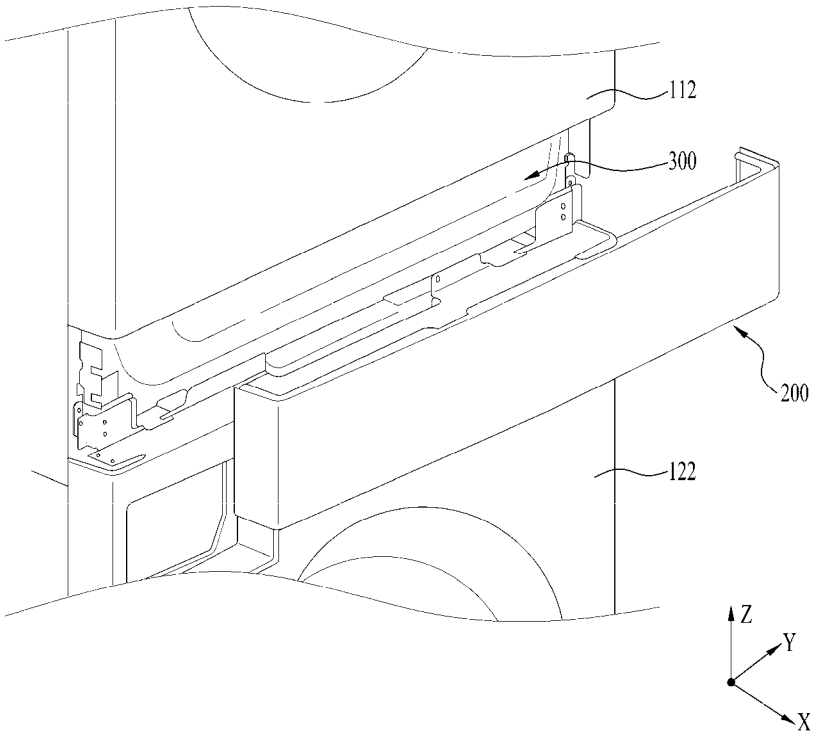
FIG. 2 is a view showing an example of a control panel separated from the laundry treating apparatus.
Figure 3:
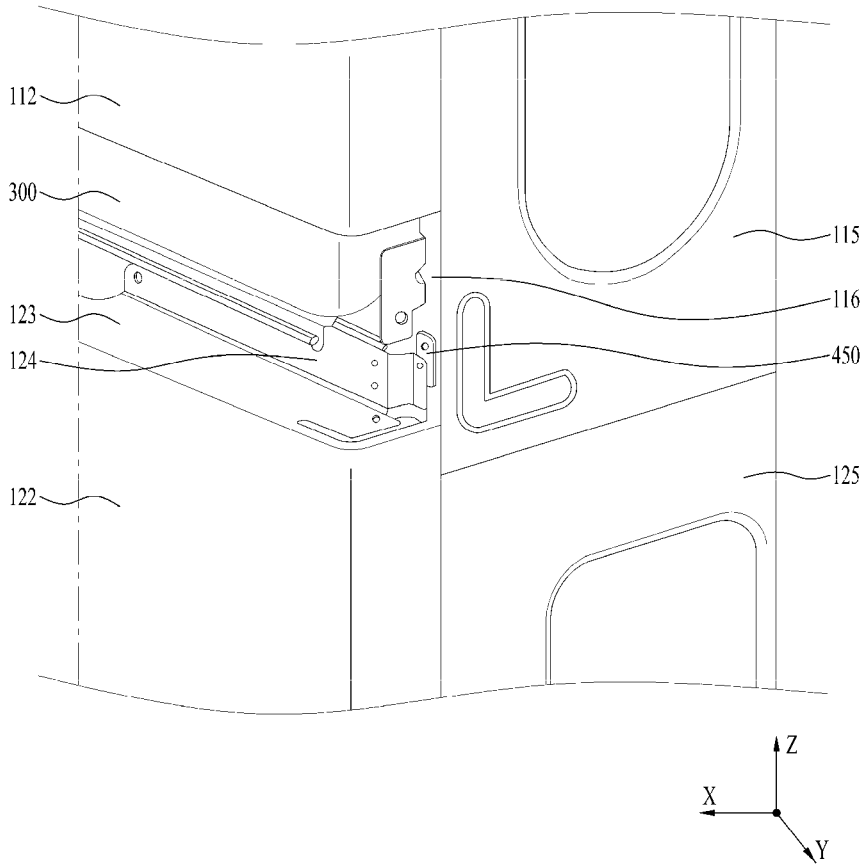
FIG. 3 is a view showing an example of a lower frame coupled to the laundry treating apparatus.
Figure 4:
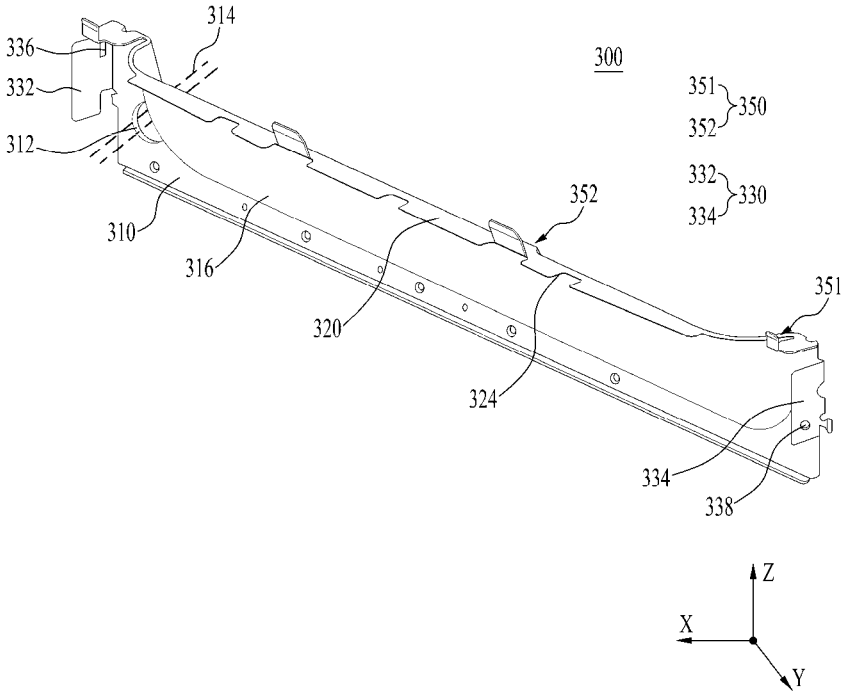
FIG. 4 is a perspective view showing the lower frame separated from the laundry treating apparatus.

FIG. 2 is a view showing a state in which the control panel 200 is separated from the laundry treating apparatus 1 in some implementations, FIG. 3 shows a lower frame 300 coupled to a lower portion of the first treating apparatus 10 in some implementations, and FIG. 4 shows a perspective view of the lower frame 300.

Referring to FIGS. 1 to 3, in some implementations, the first front panel 112 and the second front panel 122 can have different lengths in the vertical direction Z. The length of the first front panel 112 can be smaller than the length of the second front panel 122. That is, the length of the second front panel 122 can be larger than the length of the first front panel 112.

The length of the first front panel 112 can be smaller than a length of the first side panel 115. A lower end of the first front panel 112 can be positioned to be spaced upwardly apart from a lower end of the first side panel 115.

As the length of the first front panel 112 is small, the first treating apparatus 10 can be constructed such that a front portion of the bottom face of the first treating apparatus 10 is open, and the front portion of the bottom face of the first treating apparatus 10 can be shielded by the control panel 200 and an upper portion of the second front panel 122.

The length of the second front panel 122 can be larger than a length of the second side panel 125. An upper end of the second front panel 122 can be positioned at a vertical level higher than that of an upper end of the second side panel 125 and can be positioned at a front side of the first treating apparatus 10.

In some examples, the lower end of the first front panel 112 can be positioned at a vertical level higher than that of the lower end of the first side panel 115. That is, the lower end of the first front panel 112 can be spaced upwardly apart from the lower end of the first side panel 115.

The upper end of the second front panel 122 can be positioned at the vertical level higher than that of the upper end of the second side panel 125. That is, at least a portion of the upper portion of the second front panel 122 can be positioned at a vertical level higher than that of the second side panel 125. Accordingly, at least a portion of the upper portion of the second front panel 122 can be positioned in front of the first side panel 115 and can support the control panel 200.

Because the first front panel 112 has the small length, a space in which the control panel 200 and the upper portion of the second front panel 122 can be located can be secured. As the upper end of the second front panel 122 is positioned at the front side of the first treating apparatus 10, the second front panel 122 can implement a structure that facilitates the coupling between the first treating apparatus 10 and the second treating apparatus 20, and can serve as a guide for guiding a location of the first treating apparatus 10 in the front and rear direction X. The upper portion of the second front panel 122 can serve as a support for supporting the first treating apparatus 10 at the front.

As shown in FIGS. 2 to 4, in some implementations, the first treating apparatus 10 can include the lower frame 300. The lower frame 300 can be coupled to the control panel 200 at the rear of the control panel 200 to fix the control panel 200.

The lower frame 300 can be constructed to be coupled to and fix the control panel 200 inserted between the first front panel 112 and the second front panel 122. The lower frame 300 can be disposed beneath the first front panel 112 and can be disposed at the rear of the control panel 200.

The lower frame 300 can be coupled with the control panel 200 while being fixed to the first treating apparatus 10. There can be various schemes of coupling with the control panel 200, and as will be described later, the side face 240 of the control panel 200 can be coupled with lateral extension portions 330 of the lower frame 300 to fix the control panel 200.

In some implementations, the first treating apparatus 10 and the second treating apparatus 20 are arranged together such that a user can perform an efficient laundry treating process, and one control panel 200 for efficient operation of the first treating apparatus 10 and the second treating apparatus 20 is disposed between the first front panel 112 and the second front panel 122 to improve ease of use.

In addition, as described above, the lower frame 300 disposed at the rear of the control panel 200 is disposed at the lower portion of the first treating apparatus 10 such that the control panel 200 disposed between the first front panel 112 and the second front panel 122 can be stably fixed and used. In addition, the lower frame 300 and the control panel 200 are coupled to each other, so that the control panel 200 can be effectively and stably coupled and fixed.

Referring to FIG. 3, in some implementations, both side faces in the left and right direction Y of the lower frame 300 can be respectively coupled to the first side panels 115 respectively facing toward the both side faces of the lower frame 300.

In the present disclosure, the components can have the front and rear directions X parallel to each other, the left and right directions Y parallel to each other, and the vertical directions Z. For example, the front and rear direction X of the first treating apparatus 10 can be defined identically to the front and rear directions X of the second treating apparatus 20, the control panel 200, the lower frame 300, and the like. In addition, the left and right directions Y and the vertical directions Z can also be defined as in the above scheme.

The both side faces in the left and right direction Y of the lower frame 300 can be respectively coupled to the first side panels 115. The lower frame 300 can be disposed at the lower portion of the front face of the first treating apparatus 10, and the both side faces in the left and right direction Y thereof can respectively face toward the first side panels 115 at the rear of the first side panels 115.

Each first side panel 115 can include a front end bending portion 116 extending from a front end thereof as will be described later, and the lower frame 300 can be coupled to the front end bending portions 116 of the first side panels 115. As for a coupling scheme, various schemes such as screw coupling, rivet coupling, fitting coupling, and the like can be used.

In some implementations, the lower frame 300 has the both side faces in the left and right direction Y respectively coupled to the first side panels 115, and the control panel 200 disposed at the front is coupled to the lower frame 300, so that the control panel 200 that can be connected with the first treating apparatus 10 and the second treating apparatus 20 between the first front panel 112 and the second front panel 122 can have the stable fixing structure.

In some examples, referring to FIG. 4, in some implementations, the lower frame 300 can include a main frame face 310. The main frame face 310 extends along the left and right direction Y of the first treating apparatus 10 and can divide an interior of the first treating apparatus 10 from the control panel 200.

Specifically, the main frame face 310 of the lower frame 300 can be disposed in parallel with the front face 210 of the control panel 200. The main frame face 310 can extend in left and right direction Y, so that both ends thereof can be respectively coupled to the first side panels 115.

The main frame face 310 can be disposed between the interior of the first treating apparatus 10 and an interior of the control panel 200 to divide the interior of the first treating apparatus 10 from the interior of the control panel 200. Inside the first treating apparatus 10, various internals can be arranged, and there can be a large amount of water or a high-temperature air current as needed. In a process of using the first treating apparatus 10, unintended leak can occur, or the air current can affect the process.

In some implementations, influence of the water or a temperature change inside the first treating apparatus 10 on the control panel 200 can be minimized as the lower frame 300 includes the main frame face 310 that divides the control panel 200 from the interior of the first treating apparatus 10.

The main frame face 310 can have various shapes as needed, and as described later, can include a convex portion 316 to secure a space in which the internals of the first treating apparatus 10 are arranged and effectively divide the control panel 200 from the interior of the first treating apparatus 10.

In some implementations, a connection hole 312 through which a signal connection line 314 for operationally connecting the first treating apparatus 10 with the control panel 200 passes can be defined in the main frame face 310.

The above-described electric parts 224 can be arranged inside the control panel 200, and the electric parts 224 can be connected to a sensor, a motor, the controller of first treating apparatus 10, or the like disposed inside the first treating apparatus 10.

To this end, the signal connection line 314 can extend from the interior of the first treating apparatus 10 to the electric parts 224 of the control panel 200, and signal connection between components of the first treating apparatus 10 and the control panel 200 can be achieved by the signal connection line 314.

In some examples, the control panel 200 can be fixed by the lower frame 300, and the lower frame 300 can include the main frame face 310 that divides the control panel 200 from the interior of the first treating apparatus 10, so that the connection hole 312 through which the signal connection line 314 can pass can be defined in the main frame face 310.

The signal connection line 314 can have various shapes. For example, the signal connection line 314 can include a connection jack or a connection port, and can be connected to the electric parts 224 through the connection hole 312.

Figure 5:
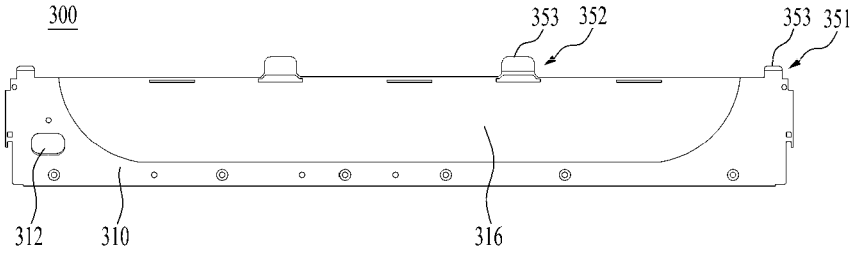
FIG. 5 is a front view showing the lower frame.

There can also be various positions and shapes of the connection hole 312. FIG. 5 is a front view showing the lower frame 300 in some implementations. Referring to FIG. 5, the connection hole 312 can be defined on one side in the left and right direction Y of the main frame face 310, and can be defined on a lower side of said one side such that the signal connection line 314 can be effectively connected to the electric parts 224.

Figure 6:
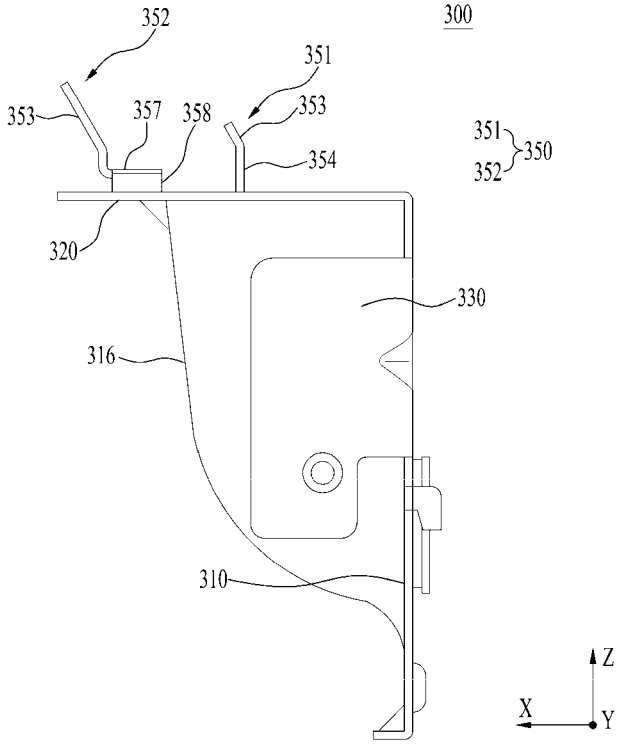
FIG. 6 is a side view showing the lower frame.

FIG. 6 shows a side view of the lower frame 300 in some implementations. Referring to FIGS. 4 to 6, in some implementations, the lower frame 300 can further include an upper extension portion 320 and a top coupling portion 350.

The upper extension portion 320 can extend forward from an upper end of the main frame face 310, and the top coupling portion 350 can protrude upward from the upper extension portion 320 and be coupled to the bottom of the first front panel 112.

The upper extension portion 320 can extend forward from the upper end of the main frame face 310 and can be positioned below the first front panel 112. The upper extension portion 320 can extend along the left and right direction Y like the main frame face 310, and can extend forward from the main frame face 310.

The top coupling portion 350 can be disposed on the upper extension portion 320. The top coupling portion 350 can protrude upward from the upper extension portion 320 positioned below the first front panel 112 and can be coupled to the bottom of the first front panel 112.

There can be various numbers, positions, and shapes of the top coupling portion 350 or schemes of coupling with the first front panel 112 as needed. For example, in some implementations, the first front panel 112 can include a lower bending portion 113, and the top coupling portion 350 can include a panel inserted portion 353 inserted into the lower bending portion 113.

Specifically, the first front panel 112 can include the lower bending portion 113 extending rearward from a lower end thereof. The lower bending portion 113 can be bent at a lower end of a front face of the first front panel 112.

The lower bending portion 113 can be disposed in parallel with the upper extension portion 320, and the top coupling portion 350 can include a panel inserted portion 353 protruding toward the lower bending portion 113 to penetrate the lower bending portion 113.

The panel inserted portion 353 can penetrate the lower bending portion 113 of the first front panel 112 and can be inserted into the bottom of the first front panel 112. The top coupling portion 350 can be coupled to the first front panel 112 as the panel inserted portion 353 penetrates and is inserted into the lower bending portion 113.

In some implementations, the lower frame 300 is fixed by being coupled with each first side panel 115, fixes the control panel 200 by being coupled to the control panel 200 at the front, is coupled to the first front panel 112 through the upper extension portion 320, and supports the first front panel 112, thereby effectively improving structural stability of the laundry treating apparatus 1 in some implementations.

Figure 7:
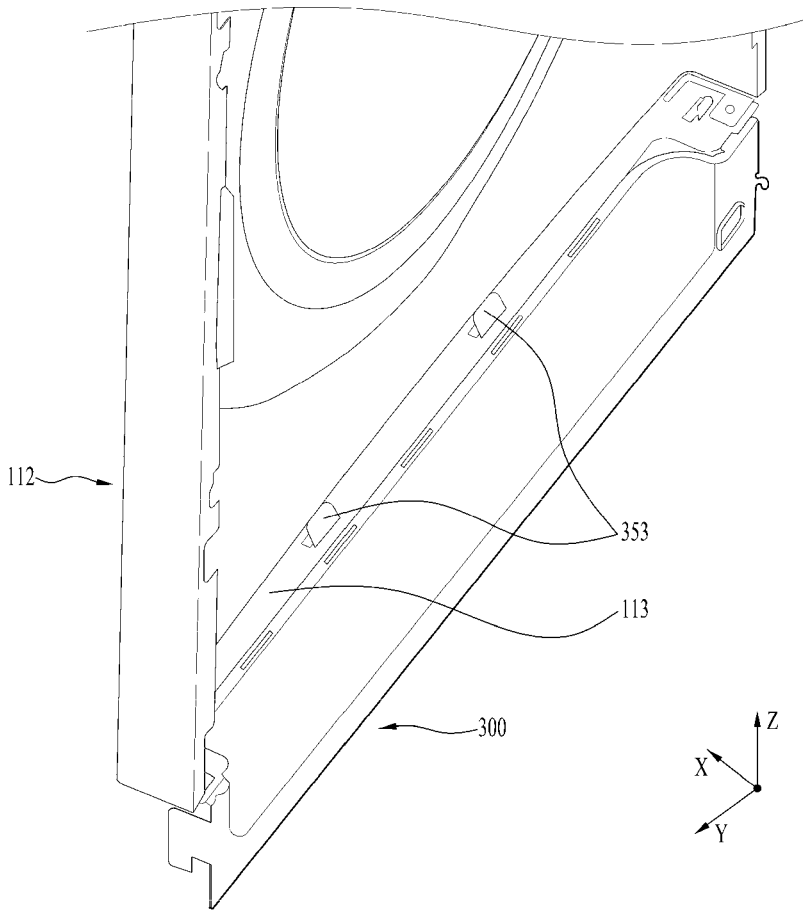
FIG. 7 is a view showing an example of a coupling structure of a first front panel and a lower frame.
Figure 8:
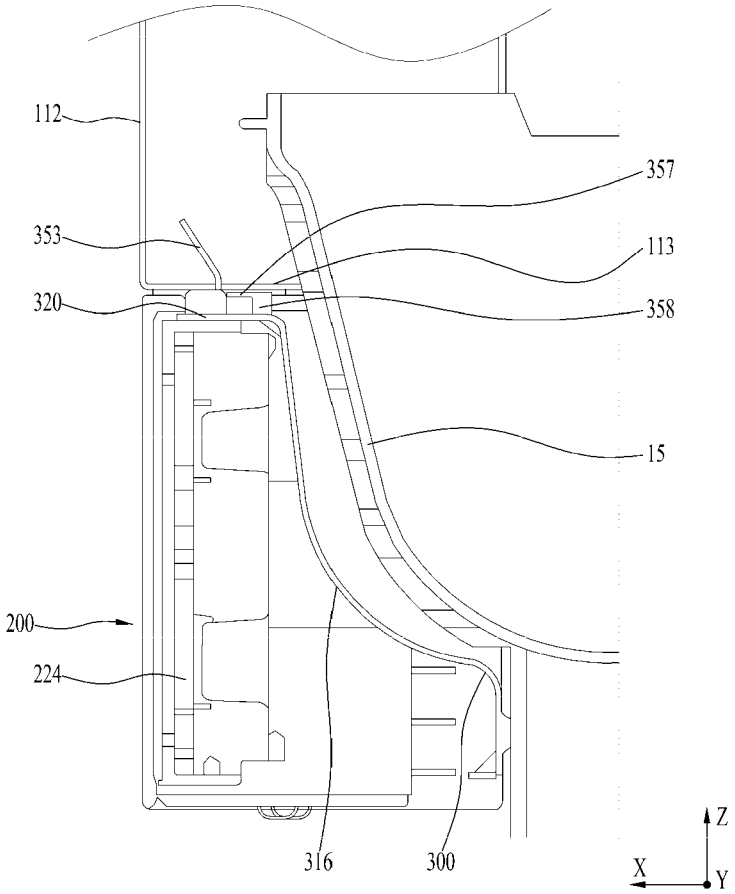
FIG. 8 is a cross-sectional view showing the lower frame and the control panel coupled to each other.

FIG. 7 shows a state in which the panel inserted portion 353 is inserted into the lower bending portion 113 of the first front panel 112 in some implementations, and FIG. 8 is a cross-sectional view showing a state in which the lower frame 300, the control panel, and the first front panel 112 are coupled to each other.

Referring to FIGS. 6 to 8, in some implementations, at least a portion of the panel inserted portion 353 can extend in an inclined manner such that an upper end thereof is positioned forwardly of a lower end thereof.

That is, the panel inserted portion 353 can be formed to be inclined forward upwardly. An inclined portion of the panel inserted portion 353 can be formed on an entirety of or only a portion of the panel inserted portion 353.

As the panel inserted portion 353 extends in the inclined manner, the upper end thereof is disposed close to the front face of the first treating apparatus 10. Accordingly, the lower bending portion 113 of the first front panel 112 is moved rearward, so that the panel inserted portion 353 can be easily inserted, and fixation of the first front panel 112 into which the panel inserted portion 353 can be strengthened.

In some examples, referring to FIGS. 6 and 8, in some implementations, the upper extension portion 320 can be spaced downwardly apart from the first front panel 112, and the top coupling portion 350 can further include an ascending extension 354. The ascending extension 354 can extend from the upper extension portion 320 toward the lower bending portion 113. In addition, the panel inserted portion 353 can be disposed at an upper end of the ascending extension 354 to penetrate the lower bending portion 113.

The first front panel 112, for example, the lower bending portion 113 of the first front panel 112 and the upper extension portion 320 can be spaced apart from each other. The top face 220 of the control panel 200 can be inserted between the upper extension portion 320 and the first front panel 112.

The top coupling portion 350 can include the ascending extension 354 extending upward from the upper extension portion 320, and the panel inserted portion 353 extending from the ascending extension 354 can be inserted into the first front panel 112.

The top fastening portion can include a first top fastening portion and a second top fastening portion. The ascending extension 354 can be included in the first top fastening portion. That is, in the first top fastening portion, the ascending extension 354 extending from the upper extension portion 320 can extend to the lower bending portion 113 of the first front panel 112, and the panel inserted portion 353 can be disposed on the upper end of the ascending extension 354 and be inserted into the first front panel 112 through the lower bending portion 113.

There can be various shapes or extension directions of the ascending extension 354, and FIG. 4 shows the plate-shaped panel inserted portion 353 extending in an inclined manner forward from the upper end of the plate-shaped ascending extension 354 in some implementations.

In some implementations, the top coupling portion 350 can include a top support 356, and the panel inserted portion 353 can be disposed on the top support 356. For example, in some implementations, the top coupling portion 350 can include a second top coupling portion 352, the second top coupling portion 352 can include the top support 356, and the panel inserted portion 353 can be disposed on the top support 356.

Specifically, the top support 356 can be disposed on the upper extension portion 320 and support the lower bending portion 113. That is, the top support 356 can be constructed such that an upper end thereof is in contact with the lower bending portion 113 and supports the lower bending portion 113 upward.

The top support 356 can have a face for supporting the lower bending portion 113 or can be formed in a protrusion shape to be in contact with the lower bending portion 113.

When the top support 356 is disposed on the top coupling portion 350, for example, in a case of the second top coupling portion 352 including the top support 356, the panel inserted portion 353 can be disposed on the top support 356 to penetrate the lower bending portion 113.

That is, the second top coupling portion 352 can be disposed such that the top support 356 is in contact with the lower bending portion 113 on the upper extension portion 320, and the panel inserted portion 353 can be disposed to protrude upward from the top support 356 to penetrate the lower bending portion 113.

As above, in some implementations, the top coupling portion 350 is constructed to include the top support 356 supporting the lower bending portion 113, so that the bottom of the first front panel 112 can be supported upward by the lower frame 300 and can be structurally stabilized.

In some examples, as shown in FIG. 6, the top support 356 can include a top support face 357 that is spaced upwardly from the upper extension portion 320, and is disposed to be in parallel with the lower bending portion 113 and supports the lower bending portion 113, and the panel inserted portion 353 can extend from the top support face 357.

The top support face 357 can be disposed to be in parallel with the lower bending portion 113, and can be disposed to be in parallel with the upper extension portion 320. That is, the top support face 357 can be in a form offset upward from the upper extension portion 320.

The top support face 357 can be preferably in a face-contact with a bottom face of the lower bending portion 113 to support the first front panel 112.

In addition, in some implementations, the top support 356 can further include a top connection portion 358 connecting the top support face 357 and the upper extension portion 320 with each other, and the panel inserted portion 353 can be disposed on a front end of the top support face 357 and at least partially extend in an inclined manner such that an upper end thereof is positioned forward of a lower end thereof.

The top support face 357 can be formed in a plate shape and can be disposed in parallel with the lower bending portion 113, and can have a connection relationship with the upper extension portion 320 by the top connection portion 358. That is, in the top support 356, the top support face 357 can be connected to the upper extension portion 320 by the top connection portion 358.

The top connection portion 358 can be formed in various shapes. FIGS. 5 to 6 show that the top connection portion 358 is formed in a substantially plate shape in some implementations and extends from one edge of the top support face 357 toward the upper extension portion 320.

In some examples, in a case of the second top coupling portion 352 having the top support 356, the panel inserted portion 353 can extend upward from the front end, that is, a front edge, of the top support face 357. Accordingly, the first front panel 112 can be supported on the top support face 357 while being moved rearward on the top of the lower frame 300, and the panel inserted portion 353 can penetrate and be coupled to the lower bending portion 113.

In addition, the top connection portion 358 can be formed at both side edges and a rear edge of the top support face 357 to stably fix the top support face 357 to the upper extension portion 320.

In some implementations, the top coupling portion 350 includes a first top coupling portion 351 having the ascending extension 354 and coupled to the first front panel 112, and a second top coupling portion 352 that supports and fixes the first front panel 112, so that a coupling strength and a support strength between the first front panel 112 and the lower frame 300 can be efficiently determined. The numbers and positions of the first top coupling portion 351 and the second top coupling portion 352 can be variously determined as needed.

FIG. 4 shows that each first top coupling portions 351 is disposed on each of both sides in the left and right direction Y of the upper extension portion 320, and second top coupling portions 352 are arranged at a center of the upper extension portion 320 in some implementations.

Figure 9:
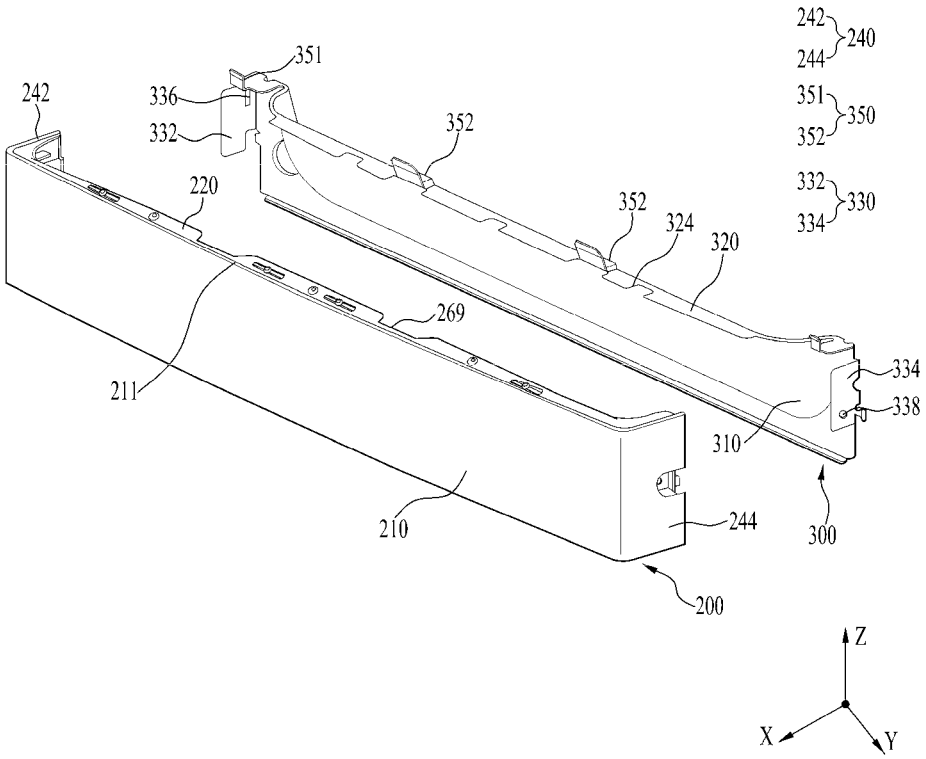
FIG. 9 is a view showing the control panel and the lower frame.
Figure 10:
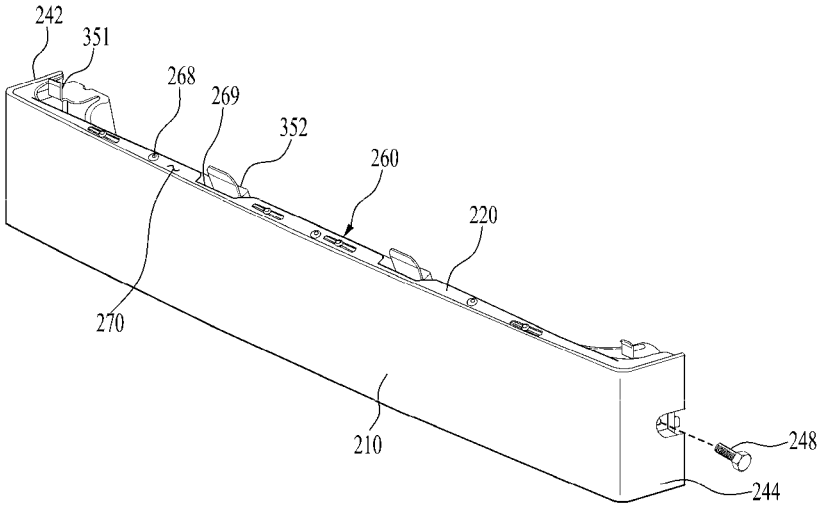
FIG. 10 is a view showing the control panel coupled to the lower frame.

FIG. 9 shows a state of the control panel 200 separated from the lower frame 300 forward, and FIG. 10 shows a state in which the lower frame 300 and the control panel 200 of FIG. 9 are coupled to each other.

Referring to FIGS. 9 and 10, in the laundry treating apparatus 1 in some implementations, the lower frame 300 can include the lateral extension portions 330, and the lateral extension portions 330 can respectively extend forward from both sides of the lower frame 300 to be coupled to the control panel 200.

As described above, the lower frame 300 has the main frame face 310 that divides the control panel 200 from the interior of the first treating apparatus 10, and can include the upper extension portion 320 to support and fix the bottom of the first front panel 112.

Furthermore, the lateral extension portions 330 can respectively extend forward from both sides in the left and right direction Y of the main frame face 310, so that the lower frame 300 can be coupled with the first front panel 112 upward, and at the same time, can be coupled with the control panel 200 in the front through the lateral extension portions 330, thereby enabling efficient space utilization and realizing a coupling structure.

The lateral extension portion 330 can include a first lateral extension portion 332 disposed on one side in the left and right direction Y of the lower frame 300 and a second lateral extension portion 334 disposed on the other side in the left and right direction Y of the lower frame 300.

In addition, the first lateral extension portion 332 can include a hook inserting portion 336 into which a side hook 246 disposed on the control panel 200 is inserted, and the second lateral extension portion 334 can include a through hole 338 coupled with a penetrating member 248 penetrating the control panel 200.

Figure 11:
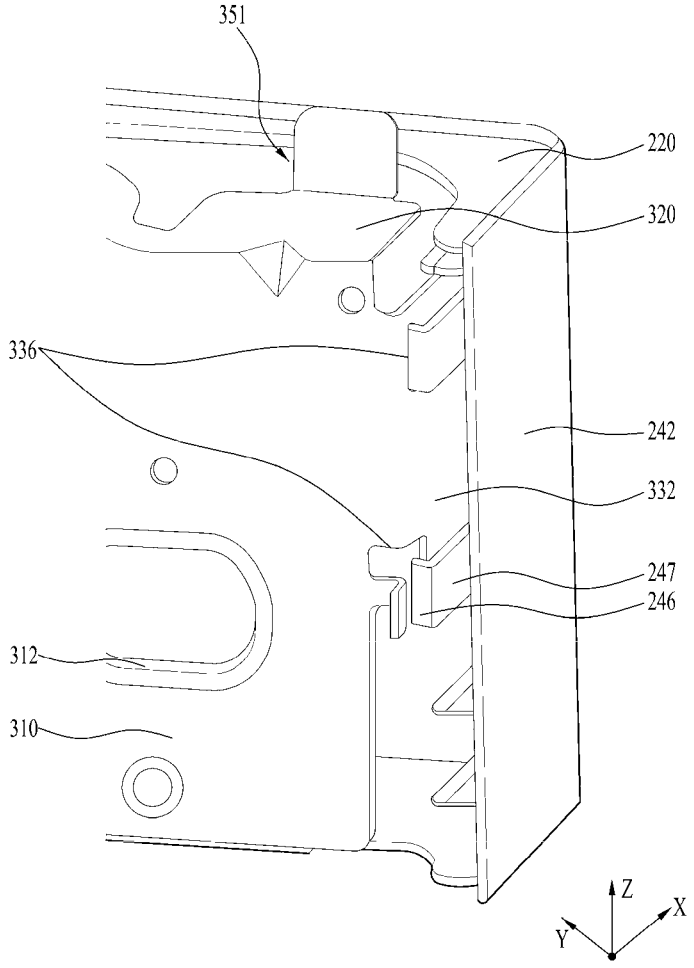
FIG. 11 is a view showing an example of a side hook of the control panel.

FIG. 9 shows the second lateral extension portion 334 including the through hole 338 to which the penetrating member 248 is coupled, and FIG. 11 is a view of the first lateral extension portion 332 including the hook inserting portion 336 viewed from the rear.

The first lateral extension portion 332 includes the hook inserting portion 336 into which the side hook 246 disposed on the control panel 200 is inserted. The control panel 200 can include a first side surface 242 on one side in the left and right direction Y, and can include the side hook 246 disposed inside the first side surface 242.

Specifically, the first lateral extension portion 332 can be disposed on one side in the left and right direction Y of the main frame face 310 to face toward an inner face of the first side surface 242, and the side hook 246 can be disposed between the first side surface 242 and the first lateral extension portion 332.

The side hook 246 can protrude toward the first lateral extension portion 332 and be inserted into the hook inserting portion 336 of the first lateral extension portion 332, so that the control panel 200 can be fixed to the lower frame 300.

The side hook 246 can protrude from one side in the left and right direction Y of the control panel 200 toward the other side and can be inserted into the first lateral extension portion 332 of the lower frame 300.

Figure 13:
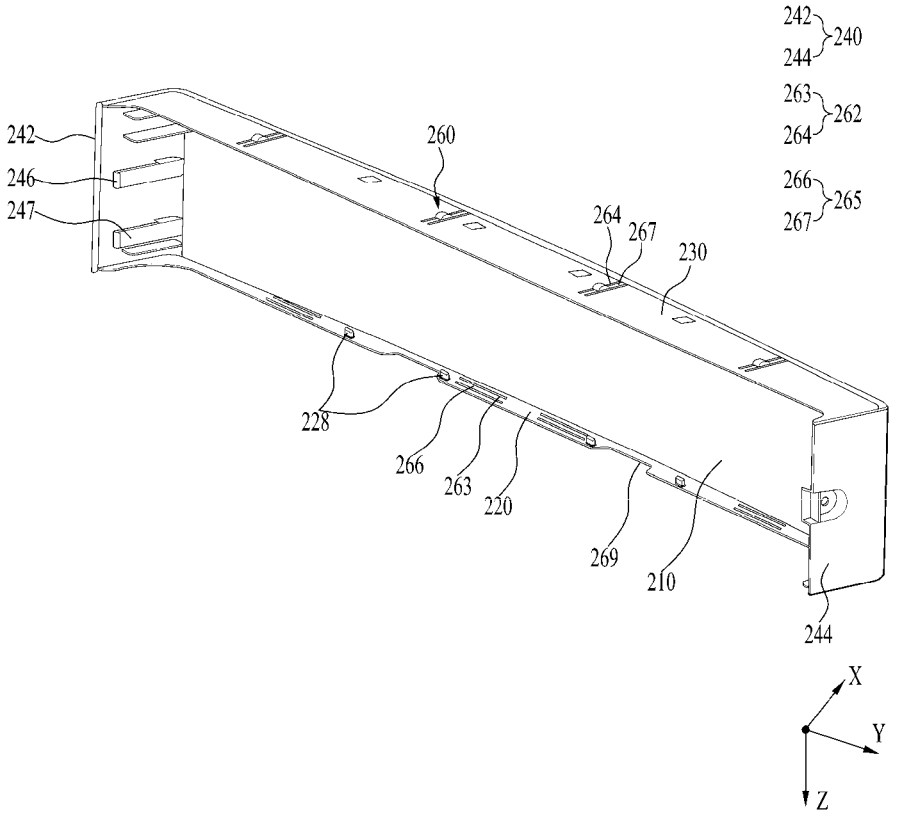
FIG. 13 is a perspective rear view showing the control panel.

In some implementations, the control panel 200 can further include a hook extension portion 247. FIG. 13 shows the hook extension portion 247 and the side hook 246 arranged on an inner face of the first side surface 242 of the control panel 200.

The hook extension portion 247 can extend rearward from the front face 210, can be located between the first side surface 242 and the first lateral extension portion 332, can be spaced apart from the first side surface 242, and can have the side hook 246 at an extended end thereof.

The hook extension portion 247 can extend rearward from the rear face of the front face 210 of the control panel 200, and can be spaced apart from the inner face of the first side surface 242, that is, one face of the first side surface 242 facing toward the other side in the left and right direction Y of the control panel 200.

As the side hook 246 and the hook extension portion 247 are arranged between the first side surface 242 of the control panel 200 and the first lateral extension portion 332 of the lower frame 300, and as the side hook 246 is disposed on an end of the hook extension portion 247 spaced apart from the first side surface 242, in an insertion process of the control panel 200, the hook extension portion 247 can be bent and deformed as needed such that the side hook 246 is inserted into the hook inserting portion 336.

For example, when the hook extension portion 247 is in close contact with the first side surface 242 or when the side hook 246 is disposed on the inner face of the first side surface 242, in the insertion process of the control panel 200, the first side surface 242 itself of the control panel 200 deforms in a process in which the side hook 246 reaches the hook inserting portion 336 of the first lateral extension portion 332, resulting in inconvenience in the coupling or a damage.

In some implementations, as the side hook 246 is disposed on the hook extension portion 247 spaced apart from the first side surface 242, in the process of coupling the control panel 200 and the lower frame 300 with each other, the hook extension portion 247 is partially bent and the side hook 246 is moved toward the hook inserting portion 336, so that effective coupling can be achieved.

In some examples, the control panel 200 can have the second side surface 244 disposed on the other side in the left and right direction Y, and the lateral extension portion 330 can further include the second lateral extension portion 334. The second lateral extension portion 334 can be disposed on the other side in the left and right direction Y of the main frame face 310 to face toward the inner face of the second side surface 244.

The second side surface 244 of the control panel 200 can be penetrated by the penetrating member 248, and the second lateral extension portion 334 of the lower frame 300 positioned on the inner face of the second side surface 244 can include the through hole 338 into which the penetrating member 248 is coupled.

The through hole 338 can be penetrated by the penetrating member 248 like the second side surface 244, or can be coupled to the penetrating member 248 as the penetrating member 248 penetrated the second side surface 244 is inserted thereto. The penetrating member 248 can have various shapes such as a screw shape, a rivet shape, or the like.

In some implementations, the first lateral extension portion 332 of the lower frame 300 is coupled with the first side surface 242 of the control panel 200 through the hook inserting portion 336, and the second lateral extension portion 334 of the lower frame 300 is coupled with the second side surface 244 of the control panel 200 through the through hole 338, so that assembly efficiency can be improved and a structure having excellent coupling stability can be implemented.

For example, when both the first lateral extension portion 332 and the second lateral extension portion 334 of the lower frame 300 are coupled with the control panel 200 in a hook manner through the hook inserting portion 336, compared to the coupling using the penetrating member 248, the coupling stability can be lower, and it can be disadvantageous in separating the control panel 200 when necessary.

In addition, when both the first lateral extension portion 332 and the second lateral extension portion 334 of the lower frame 300 are coupled with the control panel 200 using the penetrating member 248, there is no means for the control panel 200 to be fixed at an appropriate position to be coupled with the lower frame 300, and a process and a component required for the assembly process are added, which can be disadvantageous.

Accordingly, in some implementations, the first side surface 242 of the control panel 200 and the first lateral extension portion 332 of the lower frame 300 are coupled with each other through the side hook 246 and the hook inserting portions 336, so that the position of the control panel 200 at the beginning of the coupling of the control panel 200 can be effectively fixed.

In some examples, the second side surface 244 of the control panel 200 and the second lateral extension portion 334 of the lower frame 300 can be coupled with each other through the penetrating member 248 and the through hole 338 in a penetrating manner, so that a stable coupling structure in which coupling and separation are easy can be maintained.

Referring again to FIGS. 4 to 8, in some implementations, the main frame face 310 of the lower frame 300 can include the convex portion 316 that is curved such that a front face of the convex portion 316 is convex and a rear face of the convex portion 316 is concave to define a space at the rear.

The convex portion 316 can have a shape extending along the left and right direction Y of the lower frame 300 so as to be parallel with a longitudinal direction of the main frame face 310. In addition, as the front face of the convex portion 316 is convex and the rear face thereof is concave, the space is secured at the rear, so that the convex portion 316 and the components inside the first treating apparatus 10 do not interfere with each other.

FIG. 8 shows a state in which a base cabinet 15 of the first treating apparatus 10 is disposed at the rear of the main frame face 310 of the lower frame 300 in some implementations. FIG. 8 shows that the convex portion 316 of the main frame face 310 is bent so as to correspond to the base cabinet 15, and thus, a space in which the base cabinet 15 is disposed is secured without interference between the base cabinet 15 and the lower frame 300 located at the rear. The base cabinet 15 can correspond to the first bottom panel of the first treating apparatus 10 or can be a component included in the first bottom panel.

The convex portion 316 can be formed to include the top of the main frame face 310, and the upper extension portion 320 can extend from the convex portion 316. That is, the convex portion 316 can have a shape in which the space defined at the rear is opened upward.

The convex portion 316 can extend downward from the upper end of the main frame face 310 and can extend along the left and right direction Y. The connection hole 312 can be defined in the convex portion 316 or can be positioned avoiding the convex portion 316.

Because the lower frame 300 has the shape in which the convex portion 316 is formed on the top of the main frame face 310 and the space defined at the rear is opened upward, a space in which the base cabinet 15 and the like that can be positioned at the rear of the lower frame 300 can be effectively secured, and a support strength of the first front panel 112 supported by the upper extension portion 320 can be effectively improved.

Figure 12:
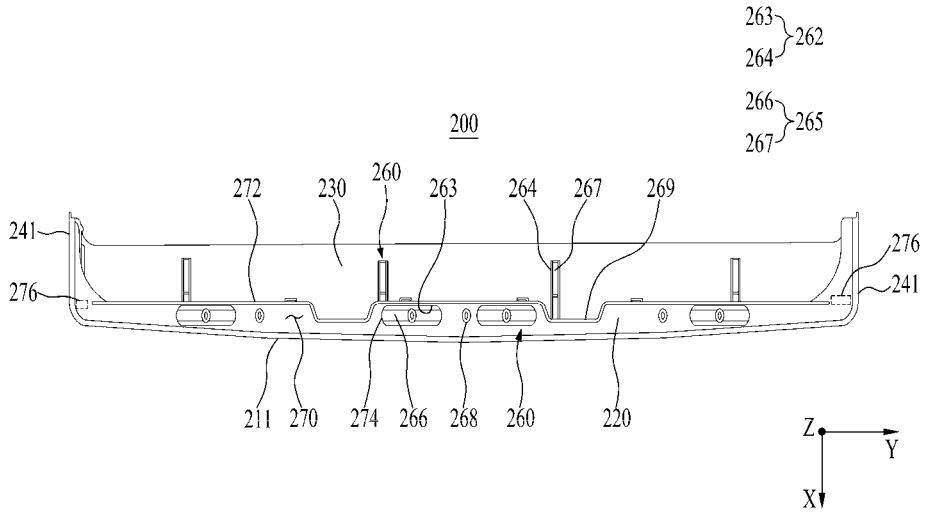
FIG. 12 is a top view showing the control panel.
Figure 14:
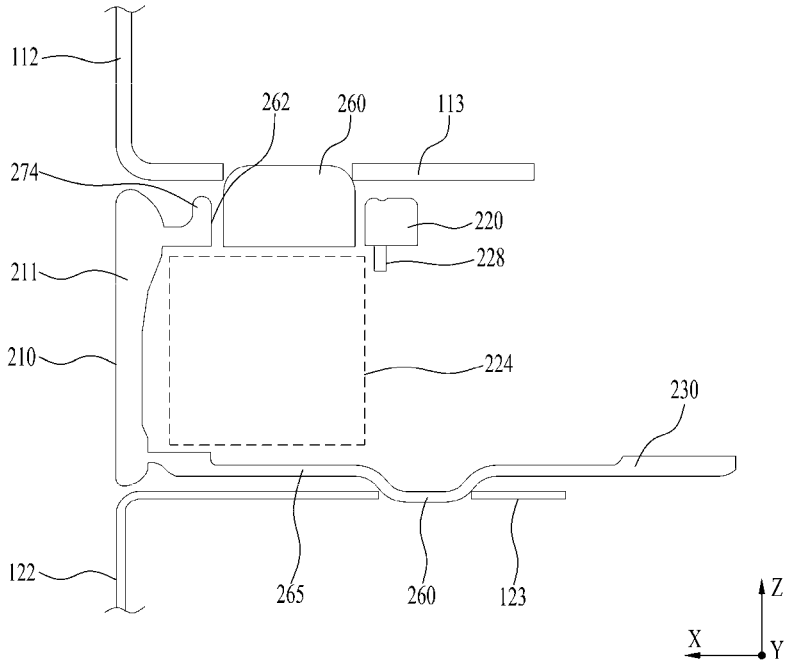
FIG. 14 is a cross-sectional view showing an example of a coupling structure of the control panel and first and second front face panels.

FIG. 12 shows a view of the control panel 200 viewed from the top, FIG. 13 shows a view of the bottom face 230 of the control panel 200 viewed from the rear, and FIG. 14 shows a cross-section of the control panel 200 coupled to the front panel 112 and the second front panel 122.

Referring to FIGS. 12 to 14, in the laundry treating apparatus 1 in some implementations, the control panel 200 can be fixed as the top thereof is coupled to the bottom of the first front panel 112 and the bottom thereof is coupled to a top of the second front panel 122.

In some implementations, a lower portion of the control panel 200 can be supported by the upper portion of the second front panel 122, and the upper portion of the control panel 200 can support the lower portion of the first front panel 112.

The control panel 200 can be coupled to the first front panel 112 in an upward direction, and coupled to the second front panel 122 in a downward direction. At least a portion of the upper portion of the second front panel 122 can support the control panel 200 and can be located at the front side of the first treating apparatus 10. The upper end of the second front panel 122 and the control panel 200 can be located at the front side of the first treating apparatus 10.

At least the portion of the upper portion of the second front panel 122 can be located at the front side of the first treating apparatus 10, and the control panel 200 can be located at the front side of the first treating apparatus 10, so that the lower portion of the control panel 200 can be coupled to the upper portion of the second front panel 122.

For example, in the control panel 200, the top face 220 can be coupled to the bottom of the first front panel 112, and the bottom face 230 of the control panel 200 can be coupled to the top of the second front panel 122. As described above, the control panel 200 can form the stable coupling structure as the side faces 240 are coupled to the lower frame 300, and at the same time, the top face 220 and the bottom face 230 are respectively coupled to the first front panel 112 and the second front panel 122.

The control panel 200 can be disposed between the first front panel 112 and the second front panel 122 and can be coupled to the first front panel 112 and the second front panel 122. In some implementations, the first treating apparatus 10 and the second treating apparatus 20 are arranged, but the first front panel 112 and the second front panel 122 are connected to each other by the control panel 200, so that the first front panel 112 and the second front panel 122 can cause an external visual effect of forming one body as a whole.

For example, the front face 210 of the control panel 200 can be constructed to form one face as a whole by connecting a front face of the first front panel 112 and a front face of the second front panel 122 with each other. Therefore, the user can identify the visually unified front face of the laundry treating apparatus 1 in some implementations.

In some examples, the control panel 200 may not be inserted into a portion of the first front panel 112 or a portion of the second front panel 122, but the control panel 200 can be directly coupled with the first front panel 112 and the second front panel 122, so that a gap between the control panel 200 and the first front panel 112 and the second front panel 122 can be minimized.

In some examples, the control panel 200 may not be inserted into one of the first front panel 112 and the second front panel 122, but the control panel 200 can be directly coupled to the first front panel 112 and the second front panel 122 to form the front face of the entire laundry treating apparatus 1, so that a coupling force between the first front panel 112, the second front panel 122, and the control panel 200 can be improved.

In some examples, the first front panel 112 and the second front panel 122 can include a metal material. For example, an entirety of the first front panel 112 and the second front panel 122 can be made of the metal material, or the first front panel 112 and the second front panel 122 can be formed in a shape in which an outer face of a plate made of the metal material is coated.

The control panel 200 can include an insulating material such as rubber, plastic, or the like. For example, an entirety of the control panel 200 can be made of the insulating material such as the plastic or the like.

As the control panel 200 is disposed between the first front panel 112 and the second front panel 122 in the vertical direction Z, when considering material properties, the control panel 200 can function as a damping member that alleviate shock or vibration applied to one of the first front panel 112 and the second front panel 122, and can also alleviate shock and vibration transmitted between the first front panel 112 and the second front panel 122.

Furthermore, the first treating apparatus 10 and the second treating apparatus can provide different laundry treating functions. Therefore, insulation between the first treating apparatus 10 and the second treating apparatus 20 can be important, and thus, insulation between the first front panel 112 and the second front panel 122 can be important.

In some implementations, the first front panel 112 and the second front panel 122 can be fastened to each other by the control panel 200, so that, because of the material characteristics of the control panel 200, the first front panel 112 and the second front panel 122 can be effectively insulated from each other.

The control panel 200 can be coupled with the first front panel 112 and the second front panel 122 in various schemes. For example, the control panel 200 in front of the lower frame 300 can move rearward to be inserted between the first front panel 112 and the second front panel 122. In the insertion process of the control panel 200, panel fastening portions 260 that can be arranged on the top face 220 and the bottom face 230 can be respectively coupled to the first front panel 112 and the second front panel 122 as will be described later.

Referring to FIG. 14, in some implementations, the second front panel 122 can include an upper bending portion 123 extending rearward from an upper end of a front face of the second front panel 122. The upper bending portion 123 can be bent from the front face of the second front panel 122.

The top of the control panel 200 can be coupled to the lower bending portion 113 of the first front panel 112, and the bottom of the control panel 200 can be coupled to the upper bending portion 123 of the second front panel 122. Specifically, the control panel 200 inserted between the first front panel 112 and the second front panel 122 is constructed such that the top thereof, that is, the top face 220 faces toward the lower bending portion 113 of the first front panel 112, and the bottom thereof, that is, the bottom face 230 faces toward the upper bending portion 123 of the second front panel 122.

The top face 220 of the control panel 200 can be disposed in parallel with the lower bending portion 113 of the first front panel 112, and the bottom face 230 of the control panel 200 can be disposed in parallel with the upper bending portion 123 of the second front panel 122. Furthermore, the lower bending portion 113 of the first front panel 112 and the upper bending portion 123 of the second front panel 122 can also be arranged to be in parallel with each other.

In the insertion process of the control panel 200, the top face 220 disposed at the top of the control panel 200 can be coupled to the lower bending portion 113 of the first front panel 112, and the bottom face 230 disposed at the bottom of the control panel 200 can be coupled to the upper bending portion 123 of the second front panel 122.

FIG. 12 shows the panel fastening portion 260 disposed on the top face 220 of the control panel 200, and FIG. 13 shows the panel fastening portion 260 disposed on the bottom face 230 of the control panel 200. Referring to FIGS. 12 and 13, the top face 220 and the bottom face 230 can include the panel fastening portions 260 respectively inserted into and coupled to the lower bending portion 113 and the upper bending portion 123 respectively facing thereto.

The panel fastening portion 260 can be formed in a hook shape and be coupled to the lower bending portion 113 or the upper bending portion 123, or can be formed in a protrusion shape and be inserted into and coupled to the lower bending portion 113 or the upper bending portion 123.

FIGS. 12 and 13 show the panel fastening portions 260 that are respectively inserted into and coupled to the lower bending portion 113 of the first front panel 112 and the upper bending portion 123 of the second front panel 122 as shown in FIG. 14 in some implementations. The number, a position, and a shape of the panel fastening portion 260 can be various as needed.

In some implementations, each of the top face 220 and the bottom face 230 can include an opening 262 open in the vertical direction Z and a fastening elastic portion 265 extending from an inner face of the opening 262 to intersect the opening 262. The panel fastening portion 260 of each of the top face 220 and the bottom face 230 can be disposed on the fastening elastic portion 265.

Specifically, a top face opening 263 can be defined in the top face 220 and a bottom face opening 264 can be defined in the bottom face 230. Each of the top face opening 263 and the bottom face opening 264 can have a shape open in the vertical direction Z and can penetrate each of the top face 220 and the bottom face 230.

The fastening elastic portion 265 can include a top face fastening elastic portion 266 disposed on the top face 220 and a bottom face fastening elastic portion 267 disposed on the bottom face 230. The top face fastening elastic portion 266 can be disposed to intersect the top face opening 263 of the top face 220, and the bottom face fastening elastic portion 267 can be disposed to intersect the bottom face opening 264 of the bottom face 230.

The fastening elastic portion 265 can extend in parallel with the top face 220 or the bottom face 230 from the inner face of each opening 262. For example, the fastening elastic portion 265 can extend from one side of the inner face of the opening 262 and can be connected to the other side of the inner face of the opening 262.

That is, the fastening elastic portion 265 can be disposed on the opening 262. Both ends of the fastening elastic portion 265 are connected to the top face 220 or the bottom face 230 of the control panel 200 in a longitudinal direction, and the remaining portion thereof is separated from the top face 220 or the bottom face 230.

Each opening 262 can have a shape extending in parallel with the longitudinal direction of the fastening elastic portion 265, and can be at least partially shielded in the vertical direction Z by the fastening elastic portion 265.

For example, the fastening elastic portion 265 can be formed by cutting both sides thereof from the top face 220 or the bottom face 230 along the longitudinal direction of the fastening elastic portion 265. Accordingly, the both ends of the fastening elastic portion 265 connected to the inner face of the opening 262 are fixed, so that a center of the fastening elastic portion 265 can be separated from the top face 220 or the bottom face 230 and be elastically deformed.

In some implementations, as the panel fastening portion 260 is disposed on the fastening elastic portion 265, in the insertion process of the control panel 200, the fastening elastic portion 265 is deformed in a process in which each panel fastening portion 260 is moved toward the lower bending portion 113 of the first front panel 112 or the upper bending portion 123 of the second front panel 122, and the fastening elastic portion 265 is restored as the panel fastening portion 260 reaches each coupling point, so that the coupling structure can be formed.

FIG. 12 shows the top face opening 263 and the top face fastening elastic portion 266 respectively defined in and disposed on the top face 220 of the control panel 200, and FIG. 13 shows the bottom face opening 264 and the bottom face fastening elastic portion 267 respectively defined in and disposed on the bottom face 230 of the control panel 200.

Figure 15:
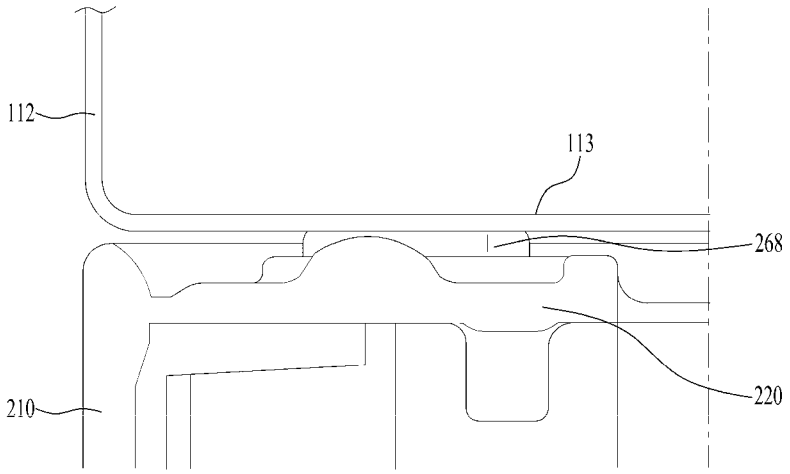
FIG. 15 is a view showing an example of a panel support of the control panel.

FIG. 12 shows a panel support 268 disposed on the top face 220 of the control panel 200 in some implementations, and FIG. 15 shows the panel support 268 supporting the lower bending portion 113 of the first front panel 112 from below.

Specifically, the panel support 268 can be distinguished from the panel fastening portion 260, and an upper end of the panel support 268 can upwardly support the lower bending portion 113 of the first front panel 112. The number and a shape of the panel supports 268 can be various, and the panel support 268 can have a top face in parallel with the lower bending portion 113.

The panel support 268 can protrude upward from the top face 220 of the control panel 200 like the panel fastening portion 260. In some examples, unlike the panel fastening portion 260 inserted into the lower bending portion 113, the panel support 268 can be in contact with the bottom face of the lower bending portion 113 to support the lower bending portion 113. The panel support 268 can have a protrusion shape like the panel fastening portion 260.

In some implementations, as the panel support 268 supporting the bottom of the first front panel 112 is disposed on the top face 220 of the control panel 200, the first front panel 112 can be stably supported. Furthermore, because the panel support 268 of the control panel 200 supports the first front panel 112 together with the top support 356 of the lower frame 300, structural stability can be improved.

In some implementations, the panel fastening portion 260 can have a protrusion height greater than that of the panel support 268. Accordingly, an entirety of the lower bending portion 113 can have a flat face, and a shape in which the panel fastening portion 260 is inserted into the lower bending portion 113 of the first front panel 112, and the panel support 268 supports the lower bending portion 113 can be realized.

Referring again to FIGS. 9 and 10, in some implementations, the top face 220 of the control panel 200 can have a coupling portion receiving groove 269 into which the top coupling portion 350 of the lower frame 300 is inserted and received.

Specifically, in some implementations, the top face 220 of the control panel 200 can be inserted between the lower bending portion 113 and the upper extension portion 320, and as described above, the upper extension portion 320 can include the top coupling portion 350 protruding upward and inserted into the lower bending portion 113.

In addition, the top face 220 can include the coupling portion receiving groove 269 that is opened rearward, and the top coupling portion 350 is inserted into the coupling portion receiving groove 269 from the rear.

The coupling portion receiving groove 269 can have a shape extending in the front and rear direction X in consideration of an insertion direction of the control panel 200, and a width of the coupling portion receiving groove 269 can be greater than that of the top coupling portion 350. A rear end of the coupling portion receiving groove 269 can be disposed to face toward the top coupling portion 350 and opened rearward, so that the top coupling portion 350 can be inserted into the coupling portion receiving groove 269 through the open rear end of the coupling portion receiving groove 269.

That is, in the process in which the control panel 200 in front of the lower frame 300 is moved rearward and inserted, the top coupling portion 350 of the lower frame 300 can move forward from the rear of the coupling portion receiving groove 269 and be inserted into the coupling portion receiving groove 269.

Accordingly, the upper extension portion 320 having the top coupling portion 350 coupled to the first front panel 112 and supporting the first front panel 112 is included in the lower frame 300. In the structure in which the top face 220 of the control panel 200 is inserted between the upper extension portion 320 and the lower bending portion 113 of the first front panel 112, the top coupling portion 350 protruding from the upper extension portion 320 of the lower frame 300 toward the lower bending portion 113 can be positioned without structural interference by the coupling portion receiving groove 269. In addition, the top face 220 of the control panel 200 can also be inserted between the first front panel 112 and the upper extension portion 320 of the lower frame 300 without interference by the top coupling portion 350.

FIG. 13 shows an electric parts coupling portion 228 protruding downward from the inner face of the top face 220 of the control panel 200, and FIG. 14 schematically shows the electric parts 224 and the electric parts coupling portion 228.

Referring to FIGS. 13 and 14, in some implementations, the control panel 200 can further include the electric parts 224 and the electric parts coupling portion 228, and the upper extension portion 320 of the lower frame 300 can include a front receiving groove 324 into which the electric parts coupling portion 228 is inserted and received.

The electric parts coupling portion 228 can protrude downward from the inner face of the top face 220 and can be coupled to the electric parts 224 inside the control panel 200. The electric parts coupling portion 228 can include a plurality of electric parts coupling portions. The electric parts coupling portion 228 can have a protrusion shape as shown in FIG. 13 and be inserted into and coupled to a groove defined in the electric parts 224, or can be disposed at a rear side to support a rear face of the electric parts 224 as shown in FIG. 14.

In some examples, the upper extension portion 320 of the lower frame 300 can be located below the top face 220 of the control panel 200, and thus, in the insertion process of the control panel 200, the electric parts coupling portion 228 can be in contact with a front end of the upper extension portion 320 and interfere with the movement of the control panel 200.

Accordingly, in some implementations, the front receiving groove 324, into which the electric parts coupling portion 228 is inserted and received, can be defined at the front end of the upper extension portion 320.

The front receiving groove 324 can be defined to face toward the electric parts coupling portion 228. That is, the front receiving groove 324 can be located at the rear of the electric parts coupling portion 228. The front receiving groove 324 can extend in the front and rear direction X in consideration of the coupling direction of the control panel 200, and a front end of the front receiving groove 324 can be opened forward.

In the process in which the control panel 200 is inserted between the first front panel 112 and the second front panel 122, the electric parts coupling portion 228 can be inserted into the front receiving groove 324 through the open front end of the front receiving groove 324. FIG. 9 shows the front receiving groove 324 defined in the upper extension portion 320 of the lower frame 300.

In some examples, as shown in FIG. 14, in some implementations, a length of the top face 220 of the control panel 200 extending rearward from the front face 210 can be less than a length of the bottom face 230 extending rearward from the front face 210, so that the interference with the upper extension portion 320 of the lower frame 300 can be prevented.

As described above, the top face 220 of the control panel 200 can be disposed adjacent to the upper extension portion 320 of the lower frame 300 in the vertical direction Z. The upper extension portion 320 of the lower frame 300 has the top coupling portion 350 coupled to the first front panel 112, and the top face 220 of the control panel 200 can have the electric parts coupling portion 228.

As such, the upper extension portion 320 of the lower frame 300 and the top face 220 of the control panel 200 can respectively have components for the coupling and the support in a relationship therebetween, which can cause the structural interference therebetween.

In consideration of the above structural features, in some implementations, the top face 220 of the control panel 200 is formed to have a smaller length than the bottom face 230, so that the structural interference between the upper extension portion 320 of the lower frame 300 and the top face 220 of the control panel 200 can be prevented, and structural degrees of freedom therebetween can be effectively improved.

In some examples, as described above, the top face opening 263 and the top face fastening elastic portion 266 can be respectively defined in and disposed on the top face 220 of the control panel 200, and the bottom face opening 264 and the bottom face fastening elastic portion 267 can be respectively defined in and disposed on the bottom face 230 of the control panel 200.

In addition, referring to FIGS. 12 and 13, in some implementations, the top face fastening elastic portion 266 can be disposed to intersect the top face opening 263 along the left and right direction Y of the control panel 200, and the bottom face fastening elastic portion 267 can be disposed to intersect the bottom face opening 264 along the front and rear direction X of the control panel 200.

That is, the top face fastening elastic portion 266 can extend along the left and right direction Y of the control panel 200, and the bottom face fastening elastic portion 267 can extend along the front and rear direction X of the control panel 200. The top face opening 263 can also extend in the left and right direction Y like the top face fastening elastic portion 266, and the bottom face opening 264 can also extend in the front and rear direction X like the bottom face fastening elastic portion 267.

As described above, at least a portion of the upper extension portion 320 of the lower frame 300 overlaps the top face 220 of the control panel 200 and has a coupling relationship with the first front panel 112 and the like, so that the top face 220 of the control panel 200 can have a length of extending from the front face 210 that is smaller than that of the bottom face 230 to minimize the structural interference with the upper extension portion 320.

Accordingly, the top face fastening elastic portion 266 disposed on the top face 220 has a disadvantage in extending in the front and rear direction X because of the small length of the top face 220. Accordingly, the top face fastening elastic portion 266 can extend in the left and right direction Y of the control panel 200. The top face opening 263 can also extend in the left and right direction Y like the top face fastening elastic portion 266.

In addition, because of the characteristics of the bottom face 230 having the larger extension length compared to the top face 220, the bottom face fastening elastic portion 267 disposed on the bottom face 230 can extend in the front and rear direction X unlike the top face fastening elastic portion 266, and the bottom face opening 264 can also extend in the front and rear direction X like the bottom face fastening elastic portion 267. The panel fastening portion 260 can protrude upward from the top face fastening elastic portion 266 and can protrude downward from the bottom face fastening elastic portion.

In some examples, referring to FIG. 12 again, the laundry treating apparatus 1 in some implementations can have a drain passage 270 extending in the left and right direction Y on the top face 220 of the control panel 200.

The drain passage 270 can extend along the left and right direction Y on the top face 220, and water falling to the top face 220 can be drained by flowing in the left and right direction Y along the drain passage 270.

Specifically, as described above, the water can exist inside the first treating apparatus 10 and the second treating apparatus 20, such as a washing machine or a condensing dryer, and the water can leak or can be generated in other operating situations of the first treating apparatus 10.

The water can fall along the first treating apparatus 10 or can be supplied to the control panel 200 in other schemes. As described above, the control panel 200 can have the display and the manipulation unit on the front side thereof, and can have the electric parts 224 therein. Therefore, it is necessary to prevent the water existing on the control panel 200 from flowing into the control panel 200 or flowing along the front face 210.

In some implementations, the drain passage 270 can be defined on the top face 220 of the control panel 200, and the inflow of the water supplied to the top face 220 of the control panel 200 to the front face 210 or the interior of the control panel 200 can be minimized through the drain passage 270.

In addition, because the control panel 200 is located below the first front panel 112, in consideration of the situation in which the water flowing downward along the first front panel 112 falls to the top face 220 of the control panel 200, in some implementations, the drain passage 270 can be formed on the top face 220 of the control panel 200.

The drain passage 270 can be formed in various shapes, and can be formed in various schemes as necessary. FIG. 12 shows a state in which the drain passage 270 opened upward is disposed on the top face 220 in some implementations.

The drain passage 270 can extend along the left and right direction Y of the control panel 200. Accordingly, the water falling to the top face 220 can flow in the left and right direction Y on the top face 220, and a phenomenon in which the water passes the rear end of the top face 220 and flows into the control panel 200 or flows along the front face 210 of the control panel 200 can be suppressed.

In some examples, referring to FIG. 12 along with FIG. 9, in some implementations, the upper end 211 of the front face 210 is located above the top face 220. The top face 220 can have a passage rib 272 protruding upward and extending in the left and right direction Y at a rear end thereof. The drain passage 270 can be formed by the upper end 211 of the front face 210 and the passage rib 272.

Specifically, the top face 220 of the control panel 200 can extend rearward from the upper end of the front face 210, and the upper end 211 of the front face 210 can be positioned higher than the top face 220. That is, the top face 220 can extend rearward from the front face 210 at a vertical level lower than that of the upper end 211 of the front face 210. In other words, the front face 210 can extend upward such that the upper end 211 is positioned higher than the top face 220.

In addition, the passage rib 272 protruding upward and extending along the left and right direction Y can be disposed at the rear end of the top face 220. The top face 220 can extend in the left and right direction Y of the control panel 200 like the front face 210, and the passage rib 272 can also extend in the left and right direction Y along the top face 220.

In addition, as described above, the top face 220 can have the coupling portion receiving groove 269 defined therein that is opened rearward at the rear end thereof. A specific extending shape of the passage rib 272 can correspond to a shape of the rear end of the top face 220. That is, the passage rib 272 can extend along the rear end of the top face 220.

The drain passage 270 can be formed on the top face 220 by the upper end 211 and the passage rib 272 of the front face 210.

That is, the upper end of the front face 210 can form one side wall of the drain passage 270, the passage rib 272 can form an opposite side wall to said one side wall of the drain passage 270, and the top face of the top face 220 can form a bottom face of the drain passage 270 to form the drain passage 270.

In some implementations as above, the drain passage 270 can be formed on an entirety of the top face of the top face 220. Accordingly, the water falling to or flowing to the top face 220 can be entirely located in the drain passage 270, or can be drained by flowing in the left and right direction Y along the drain passage 270.

In some implementations, an upper end 241 of each side face 240 of the control panel 200 can be located above the top face 220, and both ends of the passage rib 272 in the left and right direction Y can be respectively spaced apart from the side faces 240 respectively facing thereto, so that each drainage 276 can be defined between the upper end 241 of each side face 240 and the passage rib 272.

Specifically, each side face 240 extending rearward from each of both sides in the left and right direction Y of the front face 210 has the upper end 241 positioned higher than the top face 220 like the front face 210. The upper end 211 of the front face 210 and the upper end 241 of the side face 240 can extend integrally. Accordingly, the top face 220 can be disposed such that the front end and both side ends thereof are surrounded by the upper end 211 of the front face 210 and the upper end 241 of the side face 240.

Both side ends of the passage rib 272 in the left and right direction Y can be respectively spaced apart from the upper ends of the side faces 240 respectively facing thereto. That is, in the drain passage 270, an opening can be defined between each side end of the passage rib 272 and the upper end of each side face 240 to define the drainage 276. The water present on the top face 220 can be discharged from the top face 220 through the drainage 276.

In some examples, both sides in the left and right direction Y of the electric parts 224 that can be arranged inside the control panel 200 can be respectively spaced apart from the inner faces of the side faces 240 by a predetermined distance so as to be prevented from contacting the water discharged through the drainage 276.

As above, by the drain passage 270 defined by the upper end of the front face 210 and the upper ends of the side faces 240, the water falling on the top face 220 can be prevented from leaking to the outside along the front face 210 or the side faces 240, and can be discharged rearward from the both sides in the left and right direction Y of the control panel 200 through the drainages 276 respectively defined between the passage rib 272 and the side faces 240.

In addition, as shown in FIG. 12, the panel support 268 and the panel fastening portion 260 arranged on the top face 220 of the control panel 200 can be located in the drain passage 270. As described above, the panel support 268 can be disposed on the drain passage 270 to support the lower bending portion 113 of the first front panel 112, and the panel fastening portion 260 can be disposed on the drain passage 270 and penetrate the lower bending portion 113.

The panel support 268 and the panel fastening portion 260 can respectively include a plurality of panel supports and a plurality of panel fastening portions, can be arranged in left and right direction Y along the drain passage 270, and can be arranged to alternate with each other. Accordingly, a supporting force of the first front panel 112 by the panel support 268 and a fixing force of the first front panel 112 by the panel fastening portion 260 can be properly mixed and dispersed.

In some implementations, the top face 220 can further include an inflow prevention rib 274. The inflow prevention rib 274 can extend to surround the opening 262 defined in the top face 220 and protrude upward to prevent the water from flowing into the opening 262. The opening 262 can be the top face opening 263 on which the top face fastening elastic portion 266 is disposed.

The panel fastening portion 260 can be disposed in the drain passage 270 and can be disposed on the fastening elastic portion 265 disposed with the opening 262. That is, the opening 262 on which the fastening elastic portion 265 is formed can be defined in the drain passage 270, and the water on the top face 220 can fall into the control panel 200 through the opening 262.

Accordingly, in some implementations, the inflow prevention rib 274 surrounding the opening 262 can be formed on the top face 220 to prevent the water leakage through the opening 262.

The inflow prevention rib 274 can extend in a ring shape to surround a circumference of the opening 262. The ring shape can be various depending on the shape of the opening 262, and can have, for example, a polygonal or circular cross-section.

As a result, while being prevented from flowing into the opening 262 by the inflow prevention rib 274, the water on the drain passage 270 defined by the upper end of the front face 210 and the passage rib 272 can flow in the left and right direction Y along the drain passage 270 and be drained.

In some examples, as described above, in some implementations, the coupling portion receiving groove 269 can be defined in the top face 220. The passage rib 272 extending along the rear end of the top face 220 can be extended so as to correspond to the coupling portion receiving groove 269, so that the water leakage into the coupling portion receiving groove 269 can be prevented.

A portion of the passage rib 272 extending along the coupling portion receiving groove 269 can extend to correspond to the shape of the coupling portion receiving groove 269. FIG. 12 shows the passage rib 272 that extends by being bent or curved to correspond to the coupling portion receiving groove 269 having an approximately rectangular cross-section, in some implementations.

Figure 16:
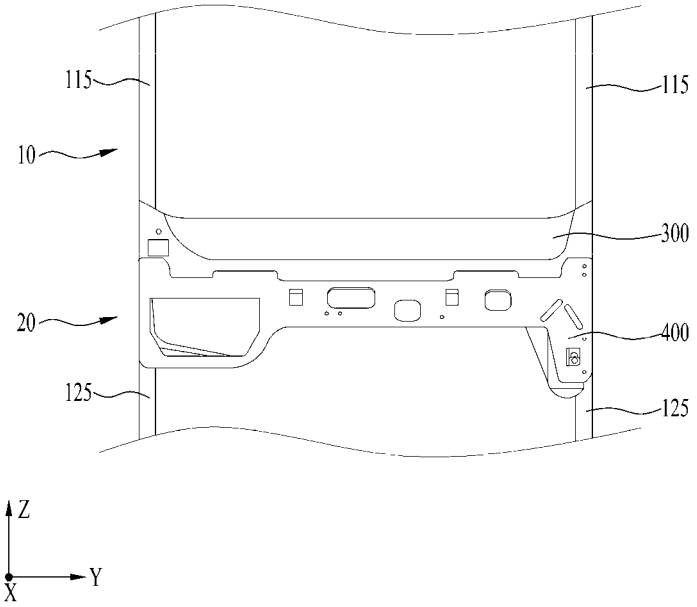
FIG. 16 is a view showing examples of a lower frame and an upper frame.

FIG. 16 shows the laundry treating apparatus 1 in which the first front panel 112 and the second front panel 122 are omitted, and shows the lower frame 300 of the first treating apparatus 10 and an upper frame 400 of the second treating apparatus 20. In addition, FIG. 17 shows an exploded perspective view of the lower frame 300 and the upper frame 400.

Figure 17:
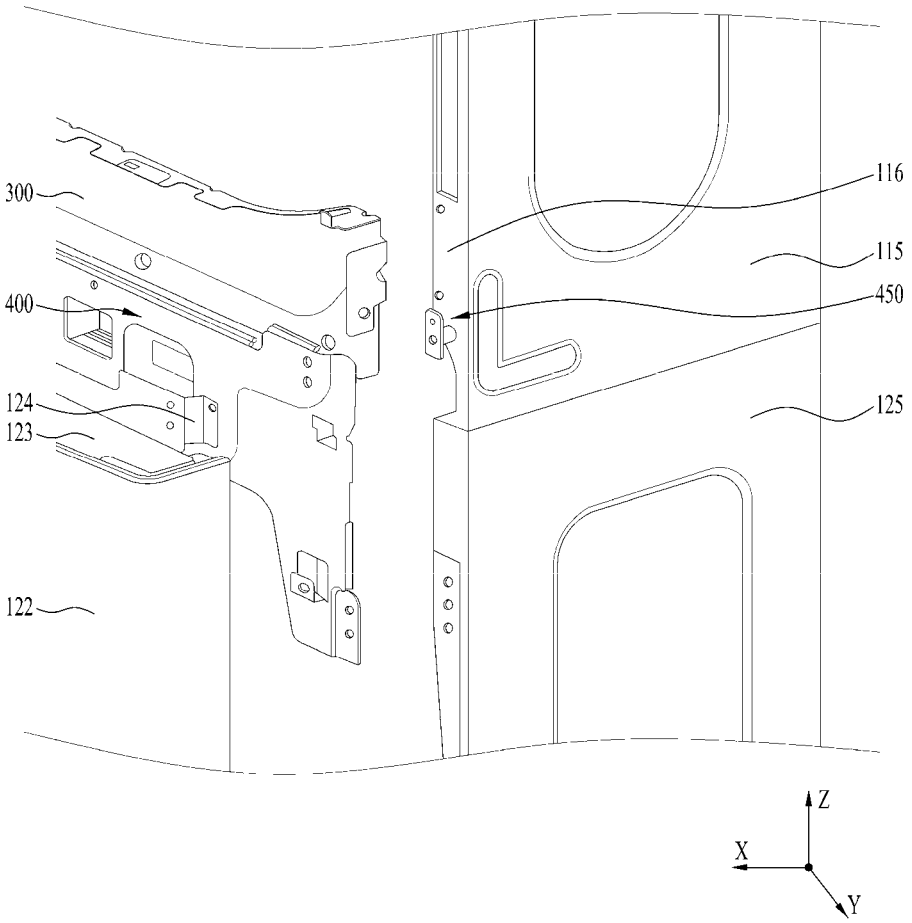
FIG. 17 is a view showing the lower frame and the upper frame that are separated from the laundry treating apparatus.

Referring to FIGS. 16 and 17, the laundry treating apparatus 1 in some implementations can include the upper frame 400. The upper frame 400 can be disposed on a rear face of the second front panel 122, and can be coupled to the first side panels 115 through insulating connection members 450 made of an insulating material, so that the upper frame 400 can be insulated from the first side panels 115.

Specifically, the upper frame 400 can be located at a top of the front face of the second treating apparatus 20, and can be coupled to the first treating apparatus 10 to fasten the first treating apparatus 10 and the second treating apparatus 20 with each other.

The upper frame 400 can be disposed on the rear face of the second front panel 122, and can be disposed in front of the second top panel and the second side panels 125 of the second treating apparatus 20 as shown in FIG. 17. That is, the upper frame 400 can be disposed between the second front panel 122 and each second side panel 125.

FIG. 16 shows a state in which a detergent opening penetrated by a detergent storage unit for supplying detergent is defined in the second treating apparatus 20. That is, in FIG. 16, the second treating apparatus 20 can correspond to the washing machine that treats the laundry using the detergent, and the detergent opening penetrated by the detergent storage unit can be defined in the upper frame 400.

The upper frame 400 can be coupled with the second side panels 125 respectively on the both sides in the left and right direction Y, and can be coupled with the second front panel 122 at the front. The upper frame 400 can contribute to improving structural stability and stiffness of the top of the second treating apparatus 20.

The upper frame 400 can be fixed to the second treating apparatus 20, and an upper portion thereof extending upward can be coupled to the lower portion of the first treating apparatus 10. The upper frame 400 can have a face parallel to the second front panel 122 and can be disposed on the front face of the second treating apparatus 20.

In some implementations, the first treating apparatus 10 and the second treating apparatus 20 can correspond to apparatuses that are independent of each other, and can respectively have components that use electricity, such as the motor, the controller, or the like, therein.

When a situation in which the electricity leaks from one of the first treating apparatus 10 and the second treating apparatus 20 occurs, it is necessary to prevent the leaked electricity from affecting the other.

That is, the first treating apparatus 10 and the second treating apparatus 20 need to be electrically insulated from each other, so that electric leakage does not occur therebetween.

In some implementations, the insulating connection member 450 can be used for fastening the upper frame 400 of the second treating apparatus 20 with the first treating apparatus 10, and the upper frame 400 can be connected to the first treating apparatus 10 through the insulating connection member 450.

The insulating connection member 450 can be made of the insulating material. The insulating material can be selected as various materials according to need, such as a plastic material, a rubber material, a mixed material of the plastic and the rubber, or the like.

The upper frame 400 can have a coupling relationship with the first front panel 112 or the first side panels 115 of the first treating apparatus 10 or other components of the first treating apparatus 10, and can be fastened to the first treating apparatus 10 through the insulating connection member 450.

That is, the insulating connection member 450 can insulate the upper frame 400 and the first treating apparatus 10 from each other while coupling the upper frame 400 with the component of the first treating apparatus 10. FIGS. 16 and 17 show a state in which the upper frame 400 is coupled to the first side panels 115 of the first treating apparatus 10 and is insulated from the first side panels 115 through the insulating connection members 450, in some implementations.

The insulating connection member 450 can be formed in various shapes, and can fasten the first treating apparatus 10 with the upper frame 400 in various fastening schemes. For example, the insulating connection member 450 can have the various fastening schemes, such as being formed in a hook shape, including a coupling member inserted therein, or being adhered to one face of the upper frame 400.

In some examples, referring to FIG. 17, in some implementations, in the upper frame 400, lower portions of both side portions in the left and right direction Y can be respectively coupled to the second side panels 125, and upper portions of the both side portions can be respectively coupled to the first side panels 115 through the insulating connection members 450.

The upper frame 400 can have a face parallel to the front face of the second front panel 122, and can extend in the left and right direction Y, so that at least portions of the both side portions in the left and right direction Y can be arranged in front of the side panels 125.

The lower portions of the both side portions of the upper frame 400 can be respectively coupled to the second side panels 125, and the upper portions of the both side portions can be respectively coupled to the first side panels 115. That is, the both sides in the left and right direction Y of the upper frame 400 can be coupled together to the first front panel 112 of the first treating apparatus 10 and the second front panel 122 of the second treating apparatus 20.

The coupling scheme of the upper frame 400 can be various. For example, a hook can be formed on the upper frame 400 and coupled to the first front panel 112 and/or the second front panel 122, and the upper frame 400 can be coupled to the first front panel 112 and/or the second front panel 122 through the coupling member such as a screw or the like as shown in FIG. 17.

Figure 18:
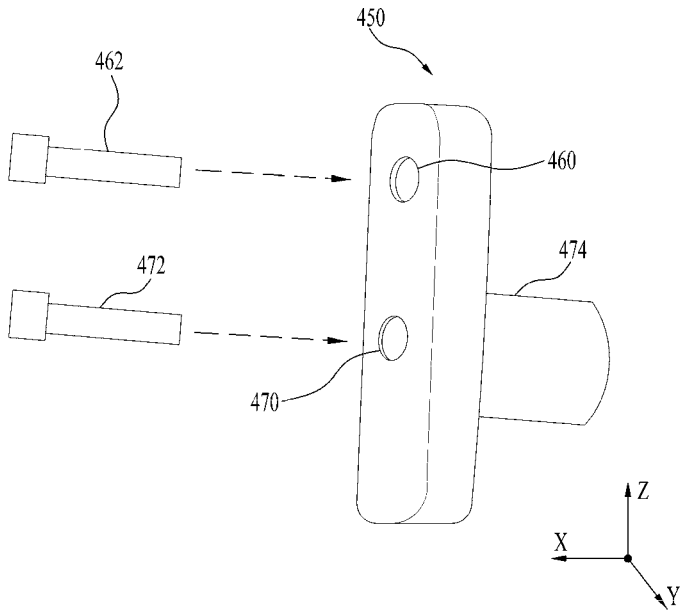
FIG. 18 is a view showing an example of an insulating connection member.

FIG. 17 shows each insulating connection member 450 that couples the upper frame 400 and each first side panel 115 with each other, and FIG. 18 shows a perspective view of the insulating connection member 450. In addition, FIG. 19 is a cross-sectional view showing the coupling structure of each first side panel 115, the insulating connection member 450, and the upper frame 400.

Figure 19:
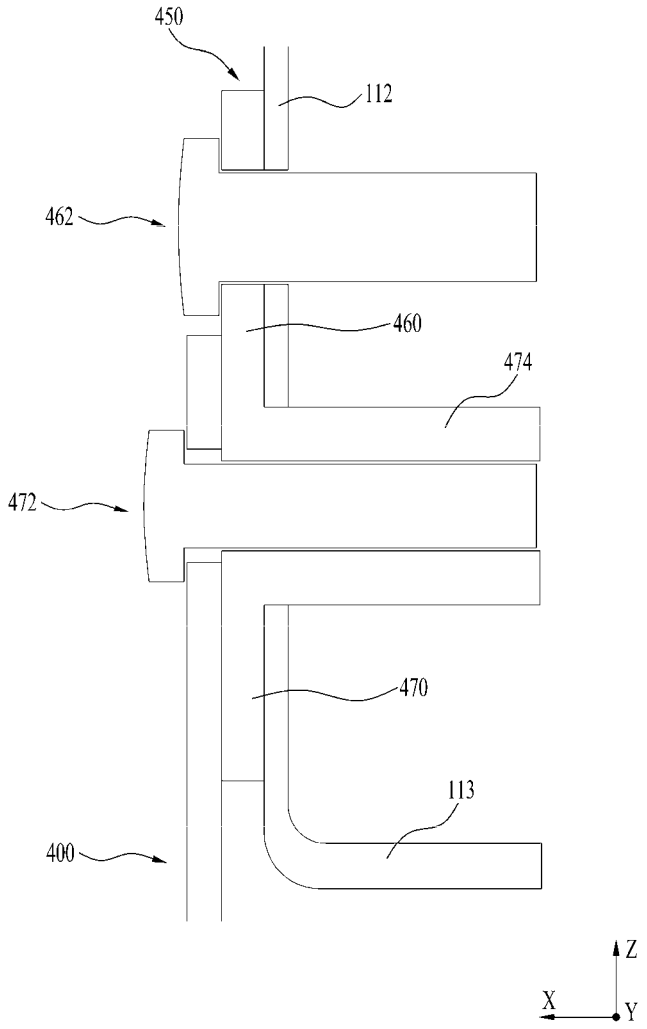
FIG. 19 is a cross-sectional view showing an example of a coupling structure of the insulating connection member and the upper frame.

Referring to FIGS. 17 to 19, in some implementations, each insulating connection member 450 can include a first fastening hole 460 and a second fastening hole 470 defined therein. The first fastening hole 460 can be coupled to the first side panel 115, the second fastening hole 470 can be coupled to the upper frame 400, and the second fastening hole 470 can insulate the upper frame 400 and the first side panel 115 from each other.

Specifically, the insulating connection member 450 can have the first fastening hole 460 and the second fastening hole 470 connected to each other. The insulating connection member 450 can be fixed to the first side panel 115 as the first fastening hole 460 is coupled to the first side panel 115.

In addition, for example, the upper portions of the both side portions of the upper frame 400 can be respectively coupled to the second fastening holes 470, and thus, the upper frame 400 can be fixed to the insulating connection members 450. That is, the upper frame 400 is fixed to the insulating connection members 450, and the insulating connection members 450 are respectively fixed to the first side panels 115, thereby the fixing structure of the coupling structure between the upper frame 400 and the first side panel 115 can be formed.

The coupling scheme between the first fastening hole 460 and the first side panel 115 and the coupling scheme between the second fastening hole 470 and the upper frame 400 can be variously determined as needed. For example, a fitting coupling, a hook coupling, or the like can be used, or the coupling relationship can be formed through a fastening member penetrating the insulating connection member 450 as shown in FIGS. 18 and 19.

The upper frame 400 is coupled to the first side panels 115 through the insulating connection members 450 made of the insulating material, so that the insulation between the upper frame 400 and the first side panels 115 can be achieved by the insulating connection members 450.

For example, as shown in FIG. 19, the second fastening hole 470 of the upper frame 400 can be positioned between the upper frame 400 and the first side panel 115 to prevent direct contact between the upper frame 400 and the first side panel 115, thereby insulating the upper frame 400 and the first side panel 115 from each other.

In some examples, the first fastening hole 460 can extend upward from the second fastening hole 470 coupled with the upper frame 400, and the upper frame 400 coupled to the second fastening hole 470 can be fastened to the first side panel 115 through the first fastening hole 460.

The both side portions of the upper frame 400 extending upward from the second treating apparatus 20 are respectively coupled to the second fastening holes 470, and the first fastening holes 460 are respectively coupled to the first side panels 115 while being respectively coupled to the second fastening holes 470, so that the first fastening hole 460 can be located above the second fastening hole 470.

That is, the first fastening hole 460 located at an upper portion of each insulating connection member 450 can be coupled to each first side panel 115, and the second fastening hole 470 located at a lower portion of each insulating connection member 450 can be coupled to the upper frame 400 while facing each side portion of the upper frame 400.

In other words, the first fastening hole 460 can be defined extending upward from the second fastening hole 470, and the second fastening hole 470 can be defined extending downward from the first fastening hole 460.

In some examples, the laundry treating apparatus 1 in some implementations can further include a first fastening member 462 and a second fastening member 472. The first fastening member 462 can penetrate the first fastening hole 460 and the first side panel 115 together to fasten the first fastening hole 460 with the first side panel 115, and the second fastening member 472 can penetrate the upper frame 400 and be inserted into the second fastening hole 470 to fasten the upper frame 400 with the second fastening hole 470. The second fastening hole 470 can insulate the second fastening member 472 and the first side panel 115 from each other.

Specifically, each insulating connection member 450 can be coupled to each first side panel 115 and the upper frame 400 through each first fastening member 462 and each second fastening member 472. The first fastening member 462 can be formed in a shape of a screw, a rivet, or the like, and can penetrate the first fastening hole 460 and the first side panel 115 together.

Because the first fastening member 462 is not directly in contact with the upper frame 400, the first fastening hole 460 does not need to insulate the first fastening member 462 and the first side panel 115 from each other.

In some examples, the upper frame 400 can be penetrated by the second fastening member 472, and the second fastening member 472 penetrated the upper frame 400 can be coupled to the second fastening hole 470 of the insulating connection member 450. In this connection, the second fastening hole 470 can be defined to insulate the second fastening member 472 and the first side panel 115 from each other.

The second fastening member 472 that can penetrate the upper frame 400 and can be in contact with and electrically connected to the upper frame 400 needs to be electrically insulated from the first side panel 115. Accordingly, the insulating connection member 450 in some implementations can be constructed such that the second fastening hole 470 insulates the second fastening member 472 and the first side panel 115 from each other.

There can be various schemes of insulating, by the second fastening hole 470, the second fastening member 472 and the first side panel 115 from each other. For example, the second fastening hole 470 can be disposed in front of the first side panel 115, and the second fastening member 472 can be inserted into and coupled to only the second fastening hole 470 excluding the first side panel 115 in the state of penetrating the upper frame 400, so that the second fastening member 472 can be insulated from the first side panel 115.

Alternatively, as shown in FIGS. 18 to 19, the second fastening hole 470 can be defined to surround the second fastening member 472 to insulate the first side panel 115 and the second fastening member 472 from each other.

In some examples, as shown in FIGS. 17 to 19, in some implementations, the second fastening hole 470 can include a fastening insulating portion 474. The fastening insulating portion 474 can extend to penetrate the first side panel 115, at least a portion of the second fastening member 472 can be inserted into the fastening insulating portion 474, and the fastening insulating portion 474 can insulate the second fastening member 472 and the first side panel 115 from each other.

The fastening insulating portion 474 can be formed in a hollow shape, and can extend along an insertion direction of the second fastening member 472 to penetrate the first side panel 115. That is, the second fastening member 472 can be constructed to penetrate the upper frame 400 and the first side panel 115 together, but a portion of the second fastening member 472 penetrating the first side panel 115 can be surrounded by the fastening insulating portion 474.

The second fastening member 472 penetrated the upper frame 400 can penetrate the second fastening hole 470 and can be inserted into and coupled to the fastening insulating portion 474. The second fastening member 472 can penetrate the upper frame 400 or the first side panel 115 in the longitudinal direction like the screw or the rivet.

The second fastening member 472 can be coupled to the second fastening hole 470 while having a length of penetrating the first side panel 115 together with the upper frame 400 by the fastening insulating portion 474, so that the coupling force can be improved. Because the second fastening member 472 is eventually inserted into and coupled to the fastening insulating portion 474 of the second fastening hole 470, the insulation between the first side panel 115 and the second fastening member 472 can be achieved. Accordingly, the upper frame 400 that can be electrically connected to the second fastening member 472 can be insulated from the first side panel 115.

The fastening insulating portion 474 can be formed in a shape in which an extended end thereof is sealed to receive the second fastening member 472 in the fastening insulating portion 474, or in a shape in which the extended end is opened and an end of the second fastening member 472 is exposed to the outside of the fastening insulating portion 474.

The fastening insulating portion 474 can be constructed to surround at least a portion of the second fastening member 472 that is positioned parallel to the first side panel 115 to receive at least a portion of the second fastening member 472 therein, and can insulate the first side panel 115 and the second fastening member 472 from each other. The first fastening member 462 and the second fastening member 472 can be separated apart from each other to be electrically separated from each other.

In some implementations, each first side panel 115 can include the front end bending portion 116 at the front end thereof. The fastening insulating portion 474 can penetrate the front end bending portion 116.

Specifically, the front end of each first side panel 115 can be located adjacent to the first front panel 112, and the front end bending portion 116 of each first side panel 115 can extend in the left and right direction Y from the front end of each first side panel 115.

That is, the front end bending portion 116 of each first side panel 115 can be disposed parallel to the front face of the first front panel 112. The first side panel 115 disposed on one side in the left and right direction Y of the first treating apparatus 10 can include the front end bending portion 116 extending toward the other side in the left and right direction Y, and the first side panel 115 disposed on the other side in the left and right direction Y of the first treating apparatus 10 can include the front end bending portion 116 extending toward said one side in the left and right direction Y.

That is, the front end bending portion 116 of the first side panel 115 can extend from a front end of a side face of the first side panel 115 forming the side face of the first treating apparatus 10 to the interior of the first treating apparatus 10. The front end bending portion 116 can be formed by being bent or curved at the side face of the first side panel 115.

The front end bending portion 116 can have a face parallel to the first front panel 112, and the first fastening member 462 and the second fastening hole 470 can have lengths in the front and rear direction X and can penetrate the front end bending portion 116 along the front and rear direction X.

The insulating connection member 450 and the upper frame 400 can be located in front of the front end bending portion 116 of the first side panel 115, and the fastening insulating portion 474 can extend rearward from the second fastening hole 470 to penetrate the front end bending portion 116.

That is, as shown in FIG. 19, in some implementations, the second fastening member 472 can penetrate the upper frame 400, the second fastening hole 470, and the front end bending portion 116 of the second side panel 125 in order. At least the portion of the second fastening member 472 can be inserted into the fastening insulating portion 474 of the second fastening hole 470 and can be coupled to the second fastening hole 470.

The second fastening hole 470 has the fastening insulating portion 474 penetrating the second side panel 125, so that the coupling force between the insulating connection member 450 and the first side panel 115 can be strengthened, and the coupling force between the second fastening member 472 and the second fastening hole 470 can also be strengthened, thereby improving the structural stability.

In some examples, as shown in FIG. 17, in some implementations, the second front panel 122 can further include an upper end fastening portion 124. The upper end fastening portion 124 can be penetrated together with the upper frame 400 by the second fastening member 472 to be fastened to the second fastening hole 470. FIG. 19 shows a coupling structure from which the upper end fastening portion 124 is omitted.

Referring to FIG. 17, the upper end fastening portion 124 can be disposed above the second front panel 122, and the upper end fastening portion 124 can be disposed on the upper bending portion 123 of the second front panel 122. That is, the upper end fastening portion 124 can have a shape extending upward from a rear end of the upper bending portion 123 extending rearward from the upper end of the second front panel 122.

The upper end fastening portion 124 can be overlapped with the upper frame 400 and the insulating connection member 450 in the front and rear direction X, and the second fastening member 472 can penetrate the upper end fastening portion 124 of the second front panel 122, the upper frame 400, the insulating connection member 450, and the first side panel 115 in order and be coupled to the second fastening hole 470 of the insulating connection member 450. In some examples, the upper end fastening portion 124 can be electrically connected to the second fastening member 472 and the upper frame 400.

Because the second front panel 122 forms a coupling relationship with each first side panel 115 by the upper end fastening portion 124, the fixing force of the second front panel 122 is improved, and at the same time, the fastening structure between the first treating apparatus 10 and the second treating apparatus 20 is also reinforced, which are advantageous.

In some examples, as shown in FIG. 17, in some implementations, the lower frame 300 of the first treating apparatus 10 is coupled to each first side panel 115 together with the upper frame 400. Portions of the lower frame 300 and the upper frame 400 connected to each first side panel 115 can be spaced apart from each other, so that the lower frame 300 and the upper frame 400 can be electrically separated from each other.

For example, a position of the portion of the upper frame 400 coupled to the first side panel 115, that is, the insulating connection member 450 is located below a position of the portion of the lower frame 300 coupled to the first side panel 115, so that the upper frame 400 can be spaced apart from the lower frame 300.

Accordingly, at the same time when the coupling between the lower frame 300 and the first side panel 115 is achieved, the coupling between the upper frame 400 and the first side panel 115 is achieved. In addition, the upper frame 400 is coupled to the first side panel 115 through the insulating connection member 450 and is spaced apart from and electrically separated from the lower frame 300. Thus, not only the structural stability of each of the first treating apparatus 10 and the second treating apparatus 20, but also the fastening force between the first treating apparatus 10 and the second treating apparatus 20 is effectively improved, so that the electrical insulation therebetween can be effectively achieved.

Figure 20:
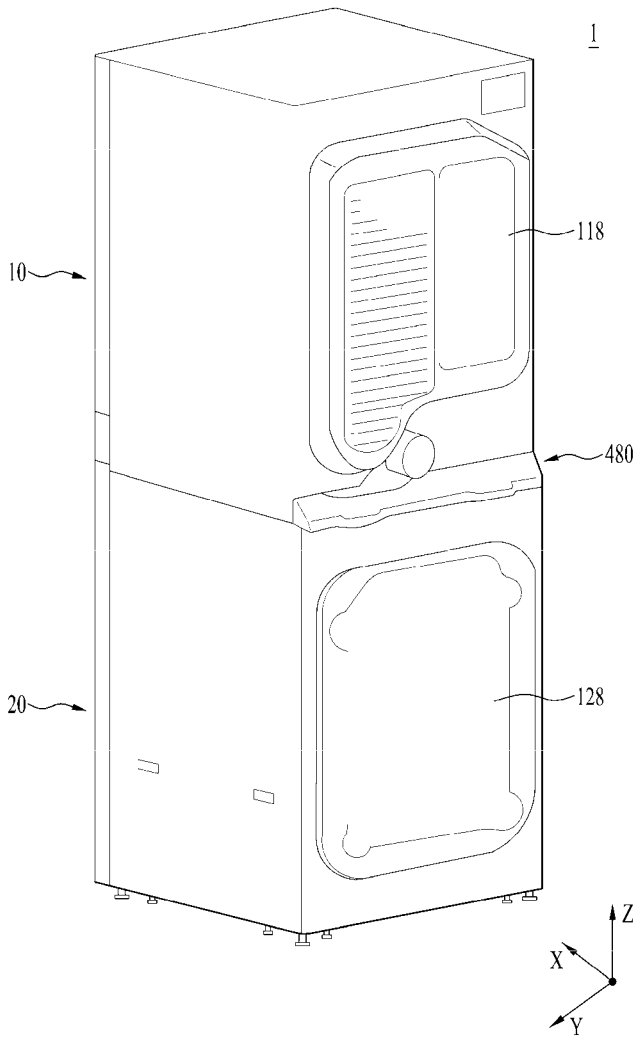
FIG. 20 is a perspective rear view of an example of a laundry treating apparatus.
Figure 21:
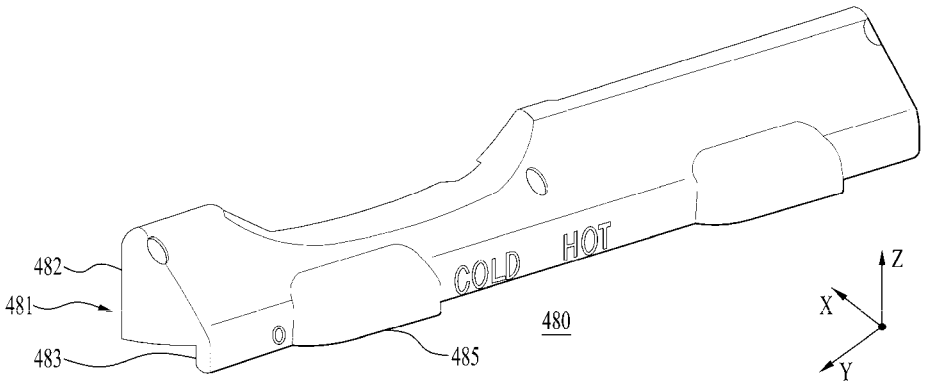
FIG. 21 is a view showing an example of a rear bracket.

FIG. 20 shows a view of the laundry treating apparatus 1 in some implementations viewed from the rear, and FIG. 21 shows a rear bracket 480 connecting the first treating apparatus 10 and the second treating apparatus 20 with each other at the rear.

As shown in FIGS. 20 and 21, in some implementations, the first treating apparatus 10 can have the first rear panel 118 disposed on the rear face thereof, and the second treating apparatus 20 can have the second rear panel 128 disposed on the rear face thereof. In addition, the rear bracket 480 made of an insulating material and fastening the first rear panel 118 and the second rear panel 128 with each other can be further included.

As described above, the first treating apparatus 10 and the second treating apparatus 20 can be electrically insulated from each other and coupled to each other by the insulating connection member 450 and the upper frame 400 at the front side. Further, the first treating apparatus 10 and the second treating apparatus 20 can be electrically insulated from each other and be coupled to each other through the rear bracket 480 at the rear side.

The first treating apparatus 10 and the second treating apparatus 20 are manufactured separately from each other, and then stacked together and installed to be used together. Therefore, in order to secure the structural stability of the laundry treating apparatus 1 in some implementations, structural fastening between the first treating apparatus 10 and the second treating apparatus 20 stacked together can be required.

Further, as described above, the first treating apparatus 10 and the second treating apparatus 20 respectively include electricity consuming devices independent of each other, such as the components like the motors, the controllers, or the like, so that it can be advantageous that the first treating apparatus 10 and the second treating apparatus 20 are electrically insulated from each other.

Accordingly, in some implementations, the first treating apparatus 10 and the second treating apparatus 20 can be fastened to each other through the upper frame 400 and the insulating connection member 450 at the front side of the first treating apparatus 10 and the second treating apparatus 20 stacked together, and can be fastened to each other through the rear bracket 480 at the rear side.

The rear bracket 480 can be made of the insulating material. For example, the rear bracket 480 can be made of the insulating material, such as a plastic material, a rubber material, or a synthetic material of the plastic and the rubber.

The rear bracket 480 can have a length parallel to the left and right direction Y, and can have a length corresponding to a width in the left and right direction Y of the first treating apparatus 10 or the treating apparatus 20. The rear bracket 480 can be coupled with the first rear panel 118 of the first treating apparatus 10 and the second rear panel 128 of the second treating apparatus 20 together to fasten the first rear panel 118 and the second rear panel 128 with each other.

There can be various coupling schemes between the rear bracket 480, the first rear panel 118, and the second rear panel 128. For example, the rear bracket 480 can be coupled to the first rear panel 118 and the second rear panel 128 together through screws, rivets, or the like, or the hook coupling or the fitting coupling scheme can be used.

Figure 22:
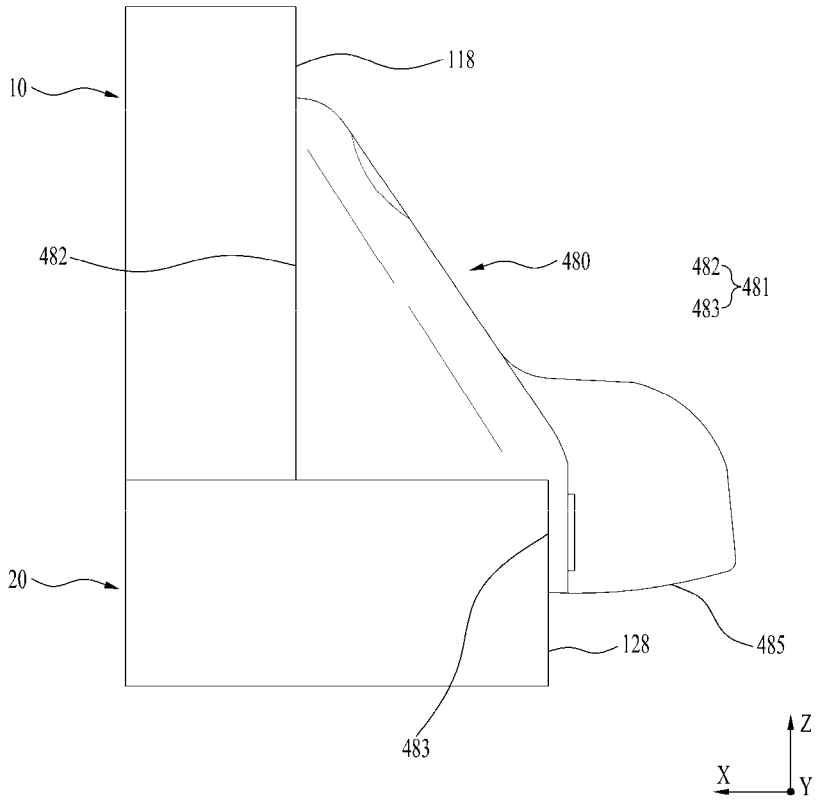
FIG. 22 is a side view showing the rear bracket.

FIG. 22 is a cross-sectional view of the rear bracket 480 coupled to the first rear panel 118 and the second rear panel 128 viewed from the side.

Referring to FIG. 22, the rear bracket 480 can fasten the first rear panel 118 and the second rear panel 128 with each other as an upper portion of the rear bracket 480 is coupled to the first rear panel 118 and a lower portion of the rear bracket 480 is coupled to the second rear panel 128.

In this connection, a front face 481 facing forward of the rear bracket 480 can have an upper end 482 in contact with the first rear panel 118, and a lower end 483 in contact with the second rear panel 128. That is, in the rear bracket 480, the upper end 482 of the front face 481 can support the first rear panel 118 from the rear, and the lower end 483 of the front face 481 can support the second rear panel 128 from the rear.

In some examples, as shown in FIG. 22, in some implementations, the first rear panel 118 can be located forward of the second rear panel 128, and the front face 481 of the rear bracket 480 can be formed in a stepped manner such that the upper end 482 supporting the first rear panel 118 is located forward of the lower end 483 supporting the second rear panel 128.

In some implementations, the first rear panel 118 and the second rear panel 128 can be arranged to be spaced apart from each other in the front and rear direction X. For example, the first rear panel 118 can be located forward or rearward of the second rear panel 128. A positional relationship of the first rear panel 118 to the second rear panel 128 can be determined from a design difference between the first treating apparatus 10 and the second treating apparatus 20.

For example, when a length in the front and rear direction X of the first treating apparatus 10 is larger than that of the second treating apparatus 20, the first rear panel 118 can be located rearward of the second rear panel 128. When the length in the front and rear direction X of the first treating apparatus 10 is smaller than that of the second treating apparatus 20, the first rear panel 118 can be located forward of the second rear panel 128.

Alternatively, for an assembly advantage for stacking the first treating apparatus 10 on the second treating apparatus 20, the first rear panel 118 can be positioned in front of the second rear panel 128. For example, in the process of assembling the laundry treating apparatus 1 in some implementations, when the second treating apparatus 20 is placed in an installation region and then the first treating apparatus 10 is lifted on the second treating apparatus 20, the first treating apparatus 10 can slide rearward from a position in front of the second treating apparatus 20 and can be disposed on the second treating apparatus 20.

In this process, the rear bracket 480 can be installed in advance on the second rear panel 128 of the second treating apparatus 20, and the first treating apparatus 10 can be disposed at an appropriate assembly position while a distance of sliding rearward is limited by the rear bracket 480.

In some implementations, the length in the front and rear direction X of the first treating apparatus 10 can be smaller than that of the second treating apparatus 20, or at least the lower portion of the first rear panel 118 can be located forward of the second rear panel 128 such that a stopper role of such rear bracket 480 can be achieved.

The front face 481 of the rear bracket 480 can have the stepped shape as shown in FIG. 22 such that the upper end 482 of the front face 481 that forwardly supports the lower portion of the first rear panel 118 is located forward of the lower end 483 that forwardly supports the upper portion of the second rear panel 128.

When the lower portion of the first rear panel 118 is located rearward of the second rear panel 128, the front face 481 of the rear bracket 480 can have the stepped shape such that the upper end 482 is positioned rearward of the lower end 483.

As the front face 481 of the rear bracket 480 has the stepped shape as above, the rear bracket 480 can be coupled to the first rear panel 118 and the second rear panel 128 and fasten the first rear panel 118 and the second rear panel 128 with each other while allowing a positional difference between the first rear panel 118 and the second rear panel 128, and a support structure for supporting the first rear panel 118 of the first treating apparatus 10 located on the second treating apparatus 20 from the rear can be stably realized.

In some examples, referring to FIGS. 21 and 22, the laundry treating apparatus 1 in some implementations can have a handle 485 on the rear bracket 480. Specifically, the handle 485 opened downward can be disposed on the lower portion of the rear bracket 480.

The handle 485 can have a shape of a groove that is open downward and recessed upward. The groove of the handle 485 can be defined such that the user can easily grip the handle 485 by putting a finger into the groove.

There can be various positions and shapes of the handle 485, and FIGS. 21 and 22 show the handle 485 that forms a portion of the lower portion of the rear bracket 480 and is opened downward to be gripped by the user, in some implementations.

Figure 23:
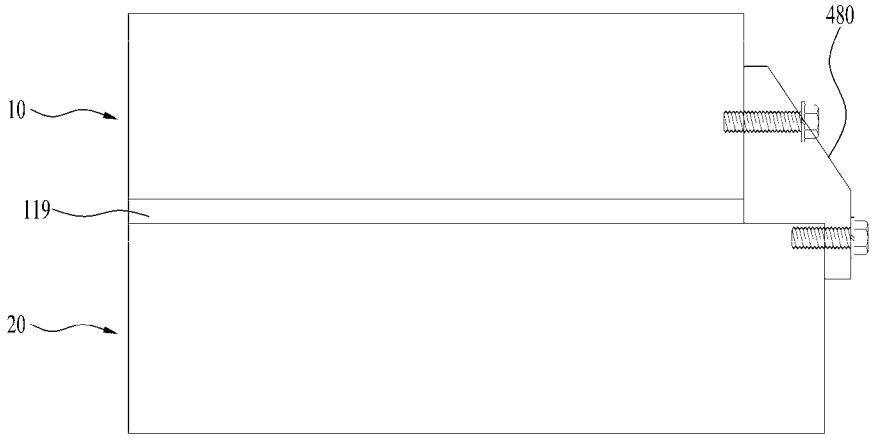
FIG. 23 is a view showing an example of a first bottom panel of a first treating apparatus.

FIG. 23 shows the first bottom panel 119 of the first treating apparatus 10 in some implementations. Referring to FIG. 1, in some implementations, the first treating apparatus 10 can further include the first bottom panel 119 made of an insulating material.

The first bottom panel 119 can be disposed on the bottom face of the first treating apparatus 10, supported by the second treating apparatus 20, and can be made of the insulating material to be insulated from the second treating apparatus 20.

In the first treating apparatus 10, the first bottom panel 119 can be located on the second treating apparatus 20, and the second treating apparatus 20 can upwardly support the first bottom panel 119 of the first treating apparatus 10. That is, the first bottom panel 119 can be in contact with the top face of the second treating apparatus 20.

In some examples, the first bottom panel 119 can be made of the insulating material. For example, the first bottom panel 119 can be made of a plastic material, a rubber material, or a synthetic material of the plastic, the rubber, and the like.

As the first bottom panel 119 in contact with and supported by the second treating apparatus 20 is made of the insulating material, the first treating apparatus 10 can be electrically insulated from the second treating apparatus 20.

That is, as described above, in some implementations, the front faces of the first treating apparatus 10 and the second treating apparatus 20 can be fastened to each other in a state electrically insulated from each other by the upper frame 400, the insulating connection member 450, and the like, and the rear faces of the first treating apparatus 10 and the second treating apparatus 20 can be fastened to each other in a state electrically insulated from each other by the rear bracket 480. Furthermore, the first bottom panel 119 of the first treating apparatus 10 can be made of the insulating material and supported on the second treating apparatus 20, so that the first treating apparatus 10 and the second treating apparatus 20 can be electrically separated from each other and can be stably fastened to each other.

In the second treating apparatus 20, the second top panel can upwardly support the first bottom panel 119 of the first treating apparatus 10, or the second side panel 125 can upwardly support the first bottom panel 119.

Figure 24:
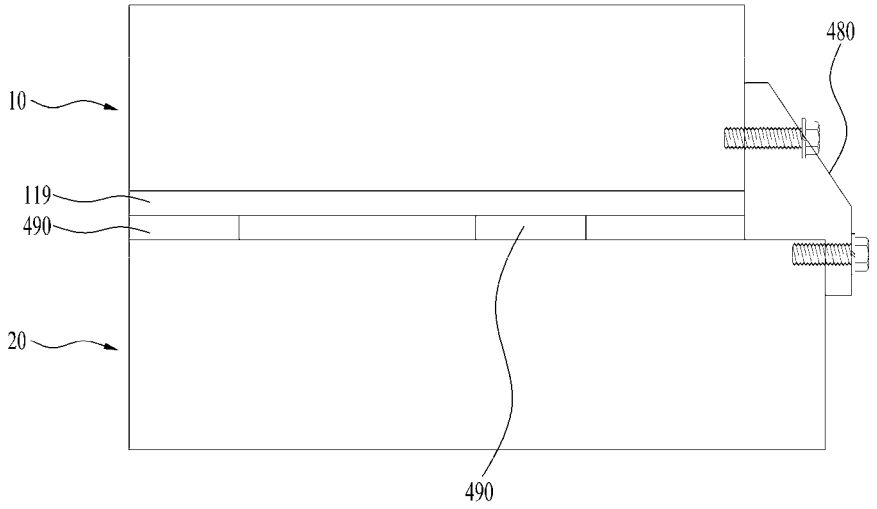
FIG. 24 is a view showing an example of an insulating support.

FIG. 24 shows a state in which an insulating support 490 is disposed between the bottom face of the first treating apparatus 10 and the top face of the second treating apparatus 20.

Referring to FIG. 24, in some implementations, the insulating support 490 that supports the bottom face of the first treating apparatus 10 from the top face of the second treating apparatus 20, and is made of an insulating material to insulate the first treating apparatus 10 and the first treating apparatus 10 from each other can be further included.

The insulating support 490 can protrude downward from the bottom face of the first treating apparatus 10, can protrude upward from the top face of the second treating apparatus 20, or can be manufactured separately from the first treating apparatus 10 and the second treating apparatus 20 and disposed between the first treating apparatus 10 and the second treating apparatus 20.

The insulating support 490 can be disposed beneath the first bottom panel 119 or the first side panel 115 of the first treating apparatus 10, and the insulating support 490 can be disposed in a state in which the first bottom panel 119 of the first treating apparatus 10 is omitted.

In addition, the insulating support 490 can be disposed on a front face of the second top panel or the second side panel 125 of the second treating apparatus 20, or can have a structure in which the second top panel of the second treating apparatus 20 is omitted.

In addition, the insulating support 490 can be disposed on a lower end of the first bottom panel 119 or the first side panel 115 of the first treating apparatus 10, and the second top panel can be omitted in the second treating apparatus 20, so that the support 490 can be supported upward by the second side panel 125 of the second treating apparatus 20.

The insulating support 490 can be formed in various shapes, and can be made of plastic or rubber, or a synthetic material of the plastic, the rubber, and the like.

As the first treating apparatus 10 is supported upward on the second treating apparatus 20 by the insulating support 490, in some implementations, the stable structure in which the first treating apparatus 10 and the second treating apparatus 20 are stacked together but are electrically insulated from each other can be realized.

Although the present disclosure has been illustrated and described in relation to a specific implementation, it is understood that the present disclosure can be variously improved and changed within the scope of the technical idea of the present disclosure provided by the following claims. It will be obvious to those of ordinary skill in the industry.

What is claimed is:

1. A stacked laundry treating apparatus comprising:

a first treating apparatus comprising (i) a first front panel disposed at a front face of the first treating apparatus and (ii) a first drum configured to accommodate laundry therein;

a second treating apparatus that is configured to be disposed vertically below the first treating apparatus and to support the first treating apparatus, the second treating apparatus comprising (ii) a second front panel disposed at a front face of the second treating apparatus and (ii) a second drum configured to accommodate laundry therein;

an upper frame that is located at a top of the front face of the second treating apparatus and extends upward to the front face of the first treating apparatus, the upper frame being configured to fasten the first treating apparatus and the second treating apparatus to each other based on the first treating apparatus being stacked on the second treating apparatus; and a control panel configured to be operationally connected to the first treating apparatus and the second treating apparatus, the control panel being configured to be inserted between the first front panel and the second front panel in a state in which the front face of the first treating apparatus and the front face of the second treating apparatus are fastened by the upper frame, wherein the upper frame is configured to be positioned behind the control panel based on the control panel being coupled between the first front panel and the second front panel, wherein the control panel comprises (i) an upper portion configured to couple to a lower portion of the first front panel and (ii) a lower portion configured to couple to an upper portion of the second front panel, and wherein the stacked laundry treating apparatus is configured to, based on the first treating apparatus and the second treating apparatus being stacked and assembled together with the control panel in a vertical direction, have a front surface comprising (i) a first portion defined by the first front panel, (ii) a second portion defined by the control panel, and (iii) a third portion defined by the second front panel, wherein the first portion, the second portion, and the third portion are arranged along the vertical direction.

2. The stacked laundry treating apparatus of claim 1, wherein the first front panel comprises a lower bending portion that extends rearward from a lower end of the first front panel, wherein the second front panel comprises an upper bending portion that extends rearward from an upper end of the second front panel, wherein the control panel includes (i) a front face defining the third portion of the front surface of the stacked laundry treating apparatus, (ii) a top face that is disposed in the upper portion of the control panel and extends rearward from the front face of the control panel, and (ii) a bottom face that is disposed in the lower portion of the control panel and extends rearward from the front face of the control panel, and wherein the top face and the bottom face of the control panel are configured to be inserted between the lower bending portion of the first front panel and the upper bending portion of the second front panel.

3. The stacked laundry treating apparatus of claim 2, wherein the top face of the control panel comprises a first panel fastening portion that is configured to be inserted into and coupled to the lower bending portion of the first front panel, and wherein the bottom face of the control panel comprises a second panel fastening portion that is configured to be inserted into and coupled to the upper bending portion of the second front panel.

4. The stacked laundry treating apparatus of claim 3, wherein each of the top face and the bottom face of the control panel defines an opening and a fastening elastic portion that extends along the opening, and wherein the first panel fastening portion is disposed at the fastening elastic portion of the top face of the control panel, and the second panel fastening portion is disposed at the fastening elastic portion of the bottom face of the control panel.

5. The stacked laundry treating apparatus of claim 3, wherein the top face of the control panel comprises a panel support that protrudes upward and supports the lower bending portion of the first front panel.

6. The stacked laundry treating apparatus of claim 2, further comprising a lower frame configured to be disposed beneath the lower bending portion of the first front panel, the lower frame being configured to be disposed at a rear side of the control panel and configured to couple to the control panel, and wherein the lower frame comprises:

a main frame face that is positioned rearward relative to the control panel and that divides an interior of the first treating apparatus and the control panel from each other; and lateral extension portions that extend forward from lateral sides of the main frame face and are configured to couple to the control panel.

7. The stacked laundry treating apparatus of claim 6, wherein the lateral extension portions comprise a first lateral extension portion that is disposed at one of the lateral sides of the main frame face and configured to face a first side surface of the control panel, the first lateral extension portion defining a hook inserting portion, and wherein the control panel further comprises a side hook that protrudes toward the first lateral extension portion of the lower frame, the side hook being configured to be inserted into the hook inserting portion and positioned between the first side surface of the control panel and the first lateral extension portion of the lower frame.

8. The stacked laundry treating apparatus of claim 7, wherein the control panel further includes a hook extension portion that extends rearward from a rear surface of the control panel, wherein the hook extension portion is configured to be spaced apart from the first side surface of the control panel and positioned between the first side surface of the control panel and the first lateral extension portion of the lower frame, and wherein the side hook is disposed at an end of the hook extension portion.

9. The stacked laundry treating apparatus of claim 7, wherein the lateral extension portions further comprise a second lateral extension portion that is disposed at another of the lateral sides of the main frame face and configured to face a second side surface of the control panel, the second lateral extension portion defining a through hole, and wherein the control panel further comprises a penetrating member that is configured to pass through the second side surface of the control panel and couple to the through hole.

10. The stacked laundry treating apparatus of claim 6, wherein the lower frame further comprises:

an upper extension portion that extends forward from an upper end of the main frame face; and a top coupling portion that protrudes upward from the upper extension portion, the top coupling portion including (i) a top support face that is spaced upwardly from the upper extension portion, that is disposed in parallel with the lower bending portion of the first front panel, and that is coupled to and support the lower bending portion of the first front panel, and (ii) a top connection portion that connects the top support face and the upper extension portion to each other.

11. The stacked laundry treating apparatus of claim 10, wherein the top face of the control panel is configured to be inserted between the lower bending portion and the upper extension portion, wherein the control panel defines a coupling portion receiving groove at a rear side of the top face of the control panel, and wherein the top coupling portion is configured to be inserted into the coupling portion receiving groove from the rear side of the top face of the control panel.

12. The stacked laundry treating apparatus of claim 6, further comprising a signal connection line that connects between electrical components disposed inside the stacked laundry treating apparatus, wherein the control panel comprises an electric parts coupling portion arranged in a rear portion of the control panel and connected to the electrical components through the signal connection line, wherein the lower frame defines a connection hole in the main frame face, the signal connection line extending from an interior of the stacked laundry treating apparatus and passing through the connection hole, and wherein one end of the signal connection line passes the connection hole and includes a connection jack configured to be connected to the electrical components, the control panel being configured to be inserted between the first front panel and the second front panel after the connection jack passes through the connection hole and is connected to the electrical components.

13. The stacked laundry treating apparatus of claim 6, wherein the main frame face extends along a left-right direction and includes a convex portion that is curved, and wherein a front face of the convex portion is convex, and a rear face of the convex portion is concave to thereby define a space at a rear side of the lower frame.

14. The stacked laundry treating apparatus of claim 2, wherein at least one of the top face or the bottom face of the control panel defines an opening and a fastening elastic portion, the fastening elastic portion extending along the opening and coupling the control panel to one of the first front panel or the second front panel.

15. The stacked laundry treating apparatus of claim 1, wherein the first treating apparatus further comprises first side panels disposed at lateral sides of the first treating apparatus, wherein a length of the second front panel in the vertical direction is greater than a length of the first front panel in the vertical direction, wherein the upper portion of the second front panel is located forward relative to the first side panels, and wherein the control panel is configured to be located forward relative to the first side panels, and the lower portion of the control panel is configured to be coupled to the upper portion of the second front panel.

16. The stacked laundry treating apparatus of claim 15, wherein a lower end of the first front panel is located vertically above than lower ends of the first side panels.

17. The stacked laundry treating apparatus of claim 1, wherein the first front panel and the second front panel comprise a metal material, and wherein the control panel comprises a plastic material configured to electrically insulate the first front panel and the second front panel from each other, the control panel being configured to absorb an impact applied to the first front panel or the second front panel.

18. The stacked laundry treating apparatus of claim 14, wherein the opening is one of opening that comprise (i) a top opening defined at the top face of the control panel and (i) a bottom opening defined at the bottom face of the control panel, wherein the fastening elastic portion is one of fastening elastic portions that comprise:

a top face fastening elastic portion that is disposed at the top face of the control panel and extends along the top opening in a lateral direction, and a top panel fastening portion that protrudes from the top face fastening elastic portion and is configured to be inserted into the lower bending portion, and wherein the bottom face of the control panel defines a bottom opening, the bottom face comprising:

a bottom face fastening elastic portion that is disposed at the bottom face of the control panel and extends in a front direction along the bottom opening, and a bottom panel fastening portion that protrudes from the bottom face fastening elastic portion and is configured to be inserted into the upper bending portion.

19. The stacked laundry treating apparatus of claim 13, wherein a length of the top face of the control panel extending rearward from the front face of the control panel is less than a length of the bottom face of the control panel extending rearward from the front face.

20. The stacked laundry treating apparatus of claim 1, further comprising an insulating connection member that is made of an insulation material and is configured to be coupled to any one of the first treating apparatus or the second treating apparatus, and wherein the upper frame is coupled to the insulating connection member such that the first and second treating apparatus are insulated from each other based on the upper frame coupling the first treating apparatus to the second treating apparatus in a stacked state.

* * * * *